US008298733B2

(12) United States Patent
Takeshima

(10) Patent No.: US 8,298,733 B2
(45) Date of Patent: Oct. 30, 2012

(54) ELECTROPHOTOGRAPHIC PHOTOSENSITIVE MEMBER

(75) Inventor: Motohiro Takeshima, Nagano (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 2042 days.

(21) Appl. No.: 10/985,012

(22) Filed: Nov. 10, 2004

(65) Prior Publication Data

US 2005/0118520 A1 Jun. 2, 2005

(30) Foreign Application Priority Data

Nov. 10, 2003 (JP) ..... 2003-380293

(51) Int. Cl.
*G03G 15/06* (2006.01)

(52) U.S. Cl. ..... 430/56; 430/60; 430/61; 430/62; 430/63; 430/64; 430/69

(58) Field of Classification Search ..... 430/56, 430/60, 61, 62, 63, 64, 69
See application file for complete search history.

(56) References Cited

U.S. PATENT DOCUMENTS

| | | | | |
|---|---|---|---|---|
| 4,617,245 | A * | 10/1986 | Tanaka et al. | 430/59.1 |
| 2003/0082470 | A1 * | 5/2003 | Asano et al. | 430/60 |

FOREIGN PATENT DOCUMENTS

| | | |
|---|---|---|
| JP | 58-100138 | 6/1983 |
| JP | 02-226161 | 9/1990 |
| JP | 03-168754 | 7/1991 |
| JP | 04-265979 | 9/1992 |
| JP | 07-271078 | 10/1995 |
| JP | 08-044096 | 2/1996 |
| JP | 2000-066428 | 3/2000 |
| JP | 2000-075528 | 3/2000 |
| JP | 2000-089494 | 3/2000 |
| JP | 2000-171996 | 6/2000 |
| JP | 2000-292954 | 10/2000 |
| JP | 2000-347433 | 12/2000 |
| JP | 2001-075299 | 3/2001 |
| JP | 2001-100595 | 4/2001 |
| JP | 2001-235885 | 8/2001 |
| JP | 2001-249477 | 9/2001 |
| JP | 2002-131938 | 5/2002 |
| JP | 2002-174921 | 6/2002 |
| JP | 2002-296822 | 10/2002 |
| JP | 2002-296823 | 10/2002 |
| JP | 2002-296824 | 10/2002 |
| JP | 2003-029441 | 1/2003 |

(Continued)

*Primary Examiner* — Hoa V Le
(74) *Attorney, Agent, or Firm* — Rabin & Berdo, P.C.

(57) ABSTRACT

In an electrophotographic apparatus (e.g., a photocopier or laser printer), an electrophotographic photosensitive member (image-forming part) has a metal substrate roughened on its surface, a metal oxide-containing undercoat layer on the substrate, and an organic photosensitive layer over the undercoat. A coherent light source (e.g., laser) can cause interference fringes that degrade the printed image. Interference fringes are judged (or predicted) as follows: The surface reflectance is measured at intervals over the spectral width of the light source. The measured surface reflectance is corrected, using a mirror-surface conductive substrate as a reference, to obtain a reflectance of the photosensitive member. The reflectance is subjected to a discrete Fourier transformation, which generates a power spectrum, over the spectral width of the light source, from the reflectance as a function of the wavelength. Interference fringes are judged from the maximum peak value in the power spectrum, as compared to a predetermined value.

9 Claims, 8 Drawing Sheets

FOREIGN PATENT DOCUMENTS

| | | |
|---|---|---|
| JP | 2003-066632 | 3/2003 |
| JP | 2003-066639 | 3/2003 |
| JP | 2003-202691 | 7/2003 |
| JP | 2003-307866 | 10/2003 |
| JP | 2003-316033 | 11/2003 |
| JP | 2003-316040 | 11/2003 |

* cited by examiner

ELECTROPHOTOGRAPHIC PHOTOSENSITIVE MEMBER

CROSS-REFERENCE TO RELATED APPLICATION

The Applicant claims the foreign priority benefit of Japanese application JP PA 2003-380293, filed on Nov. 10, 2003, the entire contents of which are entirely incorporated herein by reference.

BACKGROUND OF THE INVENTION

1. Field of the Invention

The invention relates to an electrophotographic photosensitive member adapted for use in a printer, a facsimile apparatus, or similar electrophotographic type device utilizing a laser beam as an exposure light source, and more particularly to an electrophotographic photosensitive member improved with respect to generation of interference fringes and other electrophotographic characteristics.

2. Background Art

In the invention, a printer or facsimile apparatus of the electrophotographic type preferably utilizing a laser beam as an exposure light is typified by a dry-process electrophotographic apparatus utilizing the electrophotographic process of C. F. Carlson, in which an internal electrophotographic photosensitive member is charged on a surface thereof and is subjected to exposure to form an electrostatic latent image, toner supplied from a developing device is electrostatically deposited thereon under the application of a bias voltage in a developing step, and the toner is then transferred onto paper in a transfer step, thereby obtaining an image.

In such a dry-process electrophotographic apparatus, optical interference is often generated because of the use of a coherent (monochromatic) laser beam as the exposure light source. An interference fringe pattern, such as a moiré pattern or a zebra pattern formed on a printed output image, deteriorates the image quality.

The interference fringe pattern is generated because monochromatic light reflected at a top surface of a photosensitive layer interferes with light reflected at interfaces of internal layers, including a surface of a substrate, causing optical interference due to unevenness in the layer thickness, which leads to an undulating intensity of the reflected light. In an electrophotographic photosensitive member, the largest influence is usually interference between the laser beam reflected at the surface of the conductive substrate and the laser beam reflected at the outermost surface of the photosensitive layer.

Various proposals have been made regarding the drawback of such interference fringes. It is already known, for example, to form fine irregularities on the surface of the conductive substrate by a sand blasting process, in order to cause random reflection and reduce the amount of light reflected in a particular direction, thereby suppressing or preventing the interference fringes. This is described in Japanese patent publications JP-A-2001-75299, JP-A-2001-249477, JP-A-2000-66428 and JP-A-2000-75528.

Japanese patent publications JP-A-2002-296822 and JP-A-2002-296824 describe the use of a conductive substrate having a roughened surface, which is obtained by sampling surface roughness data for a predetermined area, determining a power spectrum by a Fourier transformation, and roughening the surface so as to obtain plural peaks, and to form a photosensitive layer thereon. The resultant photosensitive member is free from image streaks.

Japanese patent publication JP-A-2002-174921 describes a photosensitive member utilizing a conductive substrate on which surface roughness is regulated to a predetermined average surface roughness and a predetermined maximum surface roughness.

The aforementioned methods for preventing interference fringes by forming fine irregularities on the surface of the conductive substrate are associated with the following drawbacks. The present inventors have conducted investigations with an organic photosensitive member in which an undercoat layer and a photosensitive layer formed by coating on a sand blasted conductive substrate have a layered structure including an undercoat layer, a charge generation layer, and a charge transport layer (such a photosensitive member being hereinafter called a "laminate organic photosensitive member"). They found that with such an organic photosensitive member the methods described in the aforementioned patent references have a certain effect for preventing interference fringes. However, they also found that the fringes cannot be eliminated to a satisfactory level by simply working the conductive substrate to a predetermined surface roughness.

For example, even on a conductive substrate which is appropriately sand blasted to prevent the interference fringes, an increase in the thickness of the undercoat layer formed by coating again gradually onto such a conductive substrate enhances interference fringes on the image. It is also known that, for such a thicker undercoat layer, the interference fringes can be suppressed to a certain extent by employing a conductive substrate in which the sand blasting treatment is applied stronger to obtain larger surface irregularities corresponding to the thickness of the undercoat layer. However, for confirming the presence or absence of interference fringes, it is necessary to: coat a photosensitive layer on the undercoat layer thereby obtaining a photosensitive drum; then to mount necessary components such as flanges on both ends of the drum; mount the photosensitive member on an image forming apparatus (actual apparatus); and to form an image. Such a method has the drawbacks of requiring time and labor and being unable to provide a result immediately. Furthermore, there is another drawback in that the interference fringes cannot always be prevented by the roughening the surface of just the conductive substrate, because s conditions inducing the interference fringes are also affected by the photosensitive layer formed on the undercoat layer.

Based on the foregoing, an analysis of the factors causing the interference fringes has led to the following consideration. In the case where an organic photosensitive member, formed by laminating a charge generation layer and a charge transport layer in succession as a photosensitive layer onto a conductive substrate provided with an undercoat layer, is irradiated with a monochromatic laser beam, the charge generation layer usually employs organic pigment particles capable of absorbing a coherent wavelength of the laser beam, as the required charge generation material. Such organic pigment particles, usually being insoluble in organic solvents, are uniformly dispersed in a resinous binder to form the charge generation layer of a satisfactory charge generating function.

A laser beam entering the photosensitive layer of such photosensitive member, upon passing the upper charge transport layer and reaching the charge generation layer, is partially absorbed by the charge generating material but also passes through the gaps between the particles of the organic pigment, thus irradiating the undercoat layer. The light irradiating the undercoat layer is divided into a light intruding into the undercoat layer and a light reflected from the surface of the undercoat layer. The light reflected at the surface of the undercoat layer reaches the outermost surface of the photosensitive layer and in turn is divided into a component outgoing from the outermost surface and a component reflected inwards at the outermost surface and directed again to the charge generation layer.

On the other hand, the light intruding into the undercoat layer, upon reflection by the conductive substrate, enters the charge generation layer again and is divided into a component absorbed by the organic pigment in the charge generation layer and a component passing through the gaps between the organic pigment particles to reach the outermost surface of the photosensitive layer. Some of this latter component goes out from this outer surface, and some is reflected inwards at the outermost surface and directed again to the charge generation layer.

Thus, in the photosensitive layer, an entering laser beam not only intrudes into a certain layer but also has a component reflected at a surface of such layer. Such reflected a component significantly influences the optical interference. A detailed consideration clarifies that the reflections which contribute to interference fringes include reflections from plural surfaces.

A first reflection factor is a superposition of a first component of the laser beam, reflected at the surface of the undercoat layer, then reaching the outermost surface of the photosensitive layer and going out to the exterior and a second component of the laser beam, reaching and reflected at the outermost surface of the photosensitive layer. The optical intensity becomes stronger in such superposing position and weaker in a non-superposing position thereby generating an unevenness in the optical intensity and causing interference fringes on the image.

Another reflection factor is interference between a light reflected at the surface of the conductive substrate and a component of the entering light reflected at the outermost surface of the photosensitive layer.

Thus, the interference fringes are principally generated in two modes, namely by a reflection from the surface of the conductive substrate and by a reflection from the surface of the undercoat layer.

The foregoing explanation on the generation of interference fringes indicates that (in the case of an organic photosensitive member having a photosensitive layer, across an undercoat layer, on a conductive substrate with a roughened surface formed by a sand blasting process) a complete prevention of interference fringes is difficult to achieve through a simple reduction of the reflection intensity in a particular direction from the surface of the conductive substrate by a random reflection caused by surface roughening, unless the surface of the undercoat layer is also roughened. In that case, the influence of the light reflected from the surface of such undercoat layer is not negligible (for example, in case a thick undercoat layer is formed).

However, in the case of most prior members, the roughening of the surface of the undercoat layer need not be considered. This is because when a thin undercoat layer is formed by coating, the surface of such an undercoat layer spontaneously has irregularities following the irregularities of the sand blasted surface of the conductive substrate, even without additional roughening of the surface of such a thin undercoat layer.

Nevertheless, a thin undercoat layer decreases the total film thickness after the formation of the photosensitive layer, thus reducing electrical resistance across the total film thickness. This structure results in a drawback of easily causing a leak in the photosensitive layer during the charging process, particularly in an image forming apparatus, such as a printer, utilizing a contact charging process. Since such a leak causes a trace of the leak on the image or a stripe-shaped image defect having a periodicity of the drum periphery, a thick undercoat layer has been required for an electrophotographic photosensitive member for use in a printer or the like.

In the case of forming a thick undercoat layer by coating, in order to prevent the aforementioned leak phenomenon, it is necessary, as explained before, to employ a conductive substrate of a surface roughness with enlarged irregularities (a larger average roughness Ra and a larger maximum surface roughness $R_{max}$) so that the roughened state of the substrate surface is reproduced on the surface of even a thick undercoat layer, or to later roughen the surface of the undercoat layer. However, the former method is limited because the layer cannot be made very thick. Also, the latter method of also roughening the surface of the undercoat layer leads to new drawbacks, namely, that fogging or a leak in the form of black spots on a white background tends to be generated corresponding to protruding parts on the surface of the undercoat layer, and that uneven density corresponding to the irregularities results in a halftone image.

Still another cause for interference fringes is deviation in the film thickness of each of the undercoat layer, the charge generation layer, and the charge transport layer. Among these, deviation in the film thickness of the charge transport layer, constituting the outermost surface of the photosensitive layer, has the largest influence. This is because the charge transport layer usually has the largest thickness, thus constituting the largest factor generating such deviation in the film thickness. As to the thickness deviation of the charge transport layer, for a semiconductor laser of a wavelength of 780 nm, a theoretically zero deviation is not necessary required, and the interference fringes of a practically unacceptable level are not generated at a film thickness deviation of 0.3 μm or less.

An experiment was conducted for confirming a correlation between the film thickness deviation and the generation of interference fringes. The experiment utilized a photosensitive drum, having a coated charge transport layer with a film thickness deviation of 1-5 μm and formed by employing a non-sand blasted conductive mirror-surface substrate (plain pipe), a coating liquid having a viscosity for forming a charge transport layer, and a seal coating method which tends to generate film thickness deviation, in order to intentionally cause interference fringes. In this experiment different interference fringe patterns were obtained according to the film thickness deviations. In order to prevent interference fringes with such mirror-surfaced plain pipe, it is at least necessary to employ a dip coating method capable of providing little film thickness deviation, thereby maintaining the film thickness deviation of the coated charge transport layer within a printing area in the axial direction and the circumferential direction of the drum at 0.3 μm or less. In practice, however, the dip coating usually provides a film thickness deviation of 0.5 to 3 μm/axial direction, or 0.5 to 1.5 μm/axial direction even under a careful operation, so that a film thickness deviation of 0.3 μm or less is, even if possible experimentally, difficult to achieve in an effective mass production. Therefore, interference fringes have been prevented by employing, as a conductive substrate as described in the aforementioned patent references, a substrate (plain pipe) which is roughened to a predetermined roughness by a sand blasting instead of a mirror-surface substrate.

In order to achieve a stable mass production of an electrophotographic photosensitive member free from interference fringes, there is desired a production method capable of avoiding interference fringes even with a somewhat larger film thickness deviation, rather than aiming at a reduction in the film thickness deviation<which is extremely difficult to achieve in mass production.

It is known, as described in the foregoing Japanese patent publications JP-A-2002-296822 and JP-A-2002-296824, to determine the relation of a substrate with a roughened surface to generation of interference fringes by sampling surface roughness data of a predetermined area and by obtaining a power spectrum through Fourier transformation, but such a relation is a function only of the surface roughness of the substrate. As will be explained later, generation of the interference fringes is also affected by conditions for forming the undercoat layer and the photosensitive layer on the substrate.

SUMMARY OF THE INVENTION

The invention has been made in consideration of the aforementioned situation, and is to provide a judging method (discriminating method) for interference fringes of an electrophotographic photosensitive member, capable of exactly confirming presence/absence of interference fringes, on a photosensitive member which is provided, on a roughened surface of a substrate, with an undercoat layer containing a metal oxide and formed by coating with a certain film thickness deviation and a photosensitive layer, without an actual image formation. The invention also provides an electrophotographic photosensitive member substantially free from generation of interference fringes, and an electrophotographic photosensitive member which is free from interference fringes and can also suppress a black spot fog on a white background, a black spot on an image by a leak phenomenon, a stripe-shaped image defect and a density unevenness.

In a first aspect of the invention, the aforementioned object can be attained by a judging method for interference fringes induced by an electrophotographic photosensitive member which is adapted to be mounted in an electrophotographic apparatus including a coherent exposure light source and which is formed by coating a metal oxide-containing undercoat layer and an organic photosensitive layer in succession on a roughened surface of a conductive substrate. The judging method includes:

measuring a surface reflectance of the electrophotographic photosensitive member at a predetermined wavelength interval $\Delta\lambda$ by a coherent light of a predetermined wavelength within a wavelength range of 750 nm$\leqq\lambda\leqq$812 nm;

correcting the obtained surface reflectance, taking a mirror-surface conductive substrate as a reference to obtain a reflectance $I_{opc}$ of the electrophotographic photosensitive member;

subjecting the reflectance to a discrete Fourier transformation according to a following equation (1) and calculating, from a result thereof, a power spectrum $|S(n/(N\cdot\Delta\lambda))|^2$ according to a following equation (2);

$$S\left(\frac{n}{N\cdot\Delta\lambda}\right)=\sum_{m=0}^{N-1}I_{OPC}(m\cdot\Delta\lambda)\exp\left(-i2\pi\cdot\frac{n}{N\cdot\Delta\lambda}\cdot m\cdot\Delta\lambda\right)=a+bi \quad (1)$$

wherein n and m represent integers, and N represents $N=2^s$ (s=1, 2, . . . , u)

$$\left|S\left(\frac{n}{N\cdot\Delta\lambda}\right)\right|^2=a^2+b^2; \quad 2)$$

and based on a peak value Sp of an evident maximum peak in the power spectrum within a frequency range of $0<n/(N\cdot\Delta\lambda)(\mathrm{Hz})\leqq2.5\times10^8$, making a judgment as:

Sp$\leqq$10: interference fringes not generated

Sp>10: interference fringes generated.

The reflectance $I_{opc}$ is determined by a method to be explained later. The power spectrum correlates a spectrum of the reflectance $I_{opc}$ with a wavelength in the abscissa and interference fringes, and reflects a layered structure (a combination of a reflectance and a surface roughness of the conductive substrate, a film thickness and a reflectance of the undercoat layer, and a film thickness and a thickness deviation of the charge generation layer and the charge transport layer) of the photosensitive member. Also, the maximum peak value Sp varies according to presence/absence of the interference fringes on an image. More specifically, the Sp value tends to increase with a higher intensity of the interference fringes generated on the image.

In a second aspect of the invention, according to the interference fringes judging method of the first aspect, the photosensitive layer is preferably formed by laminating in succession a charge generation layer containing a charge generating material and a resinous binder, and a charge transport layer containing a charge transport material and a resinous binder.

In a third aspect of the invention, according to the interference fringes judging method of the first or second aspect, the substrate surface is preferably roughened by a sand blasting process.

In a fourth aspect of the invention, the aforementioned object can be attained by an electrophotographic photosensitive member which is adapted to be mounted in an electrophotographic apparatus including a coherent exposure light source and which is formed by coating a metal oxide-containing undercoat layer and an organic photosensitive layer in succession on a roughened surface of a substrate, wherein a surface reflectance of the electrophotographic photosensitive member is measured at a predetermined wavelength interval $\Delta\lambda$ by a coherent light of a predetermined wavelength within a wavelength range of 750 nm$\leqq\lambda\leqq$812 nm (surface reflectance measurement). Then the obtained surface reflectance is corrected taking a mirror-surface conductive substrate as a reference to obtain a reflectance $I_{opc}$ of the electrophotographic photosensitive member (corrected reflectance calculation by mirror-surface substrate). Then the reflectance is subjected to a discrete Fourier transformation according to a following equation (1) to calculate a power spectrum $|S(n/(N\cdot\Delta\lambda))|^2$ according to a following equation (2) (power spectrum calculation). The surface of the conductive substrate is so roughened and the undercoat layer and the organic photosensitive layer are so formed as to satisfy a condition Sp$\leqq$10, in which Sp is a peak value of an evident maximum peak in the power spectrum within a frequency range of $0<n/(N\cdot\Delta\lambda)(\mathrm{Hz})\leqq2.5\times10^8$ $$S\left(\frac{n}{N\cdot\Delta\lambda}\right)=\sum_{m=0}^{N-1}I_{OPC}(m\cdot\Delta\lambda)\exp\left(-i2\pi\cdot\frac{n}{N\cdot\Delta\lambda}\cdot m\cdot\Delta\lambda\right)=a+bi \quad (1)$$

wherein n and m represent integers, and N represents $N=2^s$ (s=1, 2, . . . , u); and $$\left|S\left(\frac{n}{N\cdot\Delta\lambda}\right)\right|^2 = a^2 + b^2. \quad (2)$$

In a fifth aspect of the invention, the electrophotographic photosensitive member according to the fourth aspect is preferably such that the conductive substrate has an average surface roughness (Ra) within a range of 0.23 μm≦Ra≦0.35 μm and a maximum surface roughness ($R_{max}$) within a range of 2.4 μm≦$R_{max}$≦2.7 μm, and a reflectance $I_{sb}$ of the electrophotographic photosensitive member, taking a surface reflectance of a mirror-surface conductive substrate for a monochromatic light of a wavelength λ=780 nm as a reference reflectance, is within a range of Isb≦15%.

In a sixth aspect of the invention, the electrophotographic photosensitive member according to the fifth aspect is preferably such that the undercoat layer has a film thickness (d) within a range of 2 μm≦d≦3.5 μm, and a reflectance $I_{ucl}$, taking a surface reflectance of a mirror-surface conductive substrate for a monochromatic light of a wavelength λ=780 nm as a reference reflectance, is within a range of $I_{ucl}$<17%.

In a seventh aspect of the invention, the electrophotographic photosensitive member according to any of the fourth to sixth aspects is preferably such that the photosensitive layer is formed by laminating in succession a charge generation layer containing a charge generation material and a resinous binder and a charge transport layer containing a charge transport material and a resinous binder.

In an eighth aspect of the invention, the electrophotographic photosensitive member according to any of the fourth to seventh aspects is preferably such that the surface of the substrate is roughened by a sand blasting process.

Also, an electrophotographic photosensitive member without an image defect such as interference fringes can be provided by a producing process employing the judging method of the first aspect and judging a satisfactory product without interference fringe generation in case of Sp≦10. This is accomplished by incorporating the judging method of the first aspect into a process for producing an electrophotographic photosensitive member adapted to be mounted in an electrophotographic apparatus including a coherent exposure light source and which is formed by coating a metal oxide-containing undercoat layer and an organic photosensitive layer in succession on a roughened surface of a substrate.

According to the invention, there is provided a judging method for interference fringes induced by an electrophotographic photosensitive member which is adapted to be mounted in an electrophotographic apparatus including a coherent exposure light source and which is formed by coating a metal oxide-containing undercoat layer and an organic photosensitive layer in succession on a roughened surface of a substrate. A surface reflectance of the electrophotographic photosensitive member is measured at a predetermined wavelength interval Δλ by a coherent light of a predetermined wavelength within a wavelength range of 750 nm≦λ≦812 nm. Then the obtained surface reflectance is corrected taking a mirror-surface conductive substrate as a reference to obtain a reflectance $I_{opc}$ of the electrophotographic photosensitive member. Then the reflectance is subjected to a discrete Fourier transformation according to the foregoing equation (1) to calculate a power spectrum $|S(n/(N\cdot\Delta\lambda))|^2$ according to the foregoing equation (2), and, based on a peak value Sp of an evident maximum peak in the power spectrum within a frequency range of $0<n/(N\cdot\Delta\lambda)(Hz)\leqq 2.5\times10^8$, there are judged no generation of interference fringes in case of Sp≦10, and a generation of interference fringes in case of Sp>10. Also provided by the invention is a judging method for presence/absence of interference fringes of an electrophotographic photosensitive member which is provided, on a roughened surface of a substrate, with an undercoat layer containing a metal oxide and formed by coating with a certain film thickness deviation and a photosensitive layer, and in which the surface of the conductive substrate is so roughened and the undercoat layer and the organic photosensitive layer are so formed that the peak value Sp of the power spectrum satisfies a condition Sp≦10, the method being capable of confirming presence/absence of the interference fringes without an actual image formation. Also according to the invention there is provided an electrophotographic photosensitive member which is substantially free from generation of interference fringes, which can also suppress a black spot fog on a white background, a black spot on an image by a leak phenomenon, a stripe-shaped image defect and a density unevenness.

DESCRIPTION OF THE PREFERRED EMBODIMENTS

In the following, the electrophotographic photosensitive member of the invention and evaluation methods thereof will be explained with reference to the accompanying drawings. The invention is not limited to experimental examples to be explained in the following.

Figure 1:
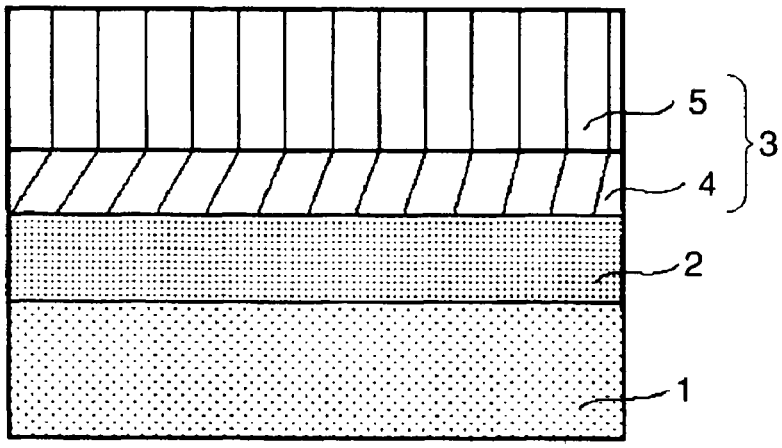
FIG. 1 is a schematic cross-sectional view of an electrophotographic photosensitive member of the invention.

FIG. 1 is a schematic cross-sectional view of an example of a photosensitive member of the invention. The photosensitive member is a negatively chargeable function-separated laminate organic photosensitive member constituted, on a conductive substrate 1 having a roughened surface, an undercoat layer 2 and a photosensitive layer 3 formed by laminating a charge generation layer 4 and a charge transport layer 5 in succession.

The conductive substrate 1 serves as an electrode for the photosensitive member and also as a support for the layers constituting the photosensitive member. It may have for example any of a cylindrical shape, a plate shape, and a film shape, and is constituted for example of a metal such as aluminum, stainless steel or nickel. The conductive substrate preferably is subjected, on a surface thereof, to a roughening process such as sand blasting in order to prevent interference fringes. A medium employed for sand blasting can be, for example, alumina, zirconia, or glass beads.

The undercoat layer 2 is formed principally of an organic resinous binder and a metal oxide which regulates conductivity of the layer, functioning as a light scattering material thereby controlling charge transfer between the photosensitive layer and the substrate even at a certain film thickness. It has the purposes of covering any defect on the substrate surface and improving adhesion between the photosensitive layer and the substrate. The resinous material to be employed in the undercoat layer can be an insulating polymer such as casein, polyvinyl alcohol, polyamide, melamine, or cellulose, or a conductive polymer such as polythiophene, polypyrole or polyaniline, and such resins may be employed singly or in a suitable combination. The metal oxide to be dispersed as a light scattering material in such resin is preferably titanium dioxide or zinc oxide.

The charge generation layer 4 is formed by coating and drying a coating liquid in which particles of a charge generation material are dispersed in a resinous binder and a solvent, and generates a charge upon receiving light. It is important that the layer 4 has a high charge generating efficiency and a property of efficiently injecting thus-generated charge into the charge transport layer 5, and it is desirable that the layer 4 has a low dependence on an electric field and has satisfactory charge injection even in a low electric field. The charge generation material can be various phthalocyanine compounds or derivatives thereof, such as a metal-free phthalocyanine. The resinous binder can be polyester resin, polyvinyl acetate, polyacrylate ester, polymethacrylate ester, polyester, polycarbonate, polyvinyl acetacetal, polyvinyl propional, polyvinyl butyral, phenoxy resin, epoxy resin, urethane resin, cellulose ester, or cellulose ether which can be used in a suitable combination.

A ratio of the resinous binder and the charge generation material is 5 to 500 parts by weight of the charge generation material (preferably 10 to 100 parts by weight) to 10 parts by weight of the resinous binder. A thickness of the charge generation layer 4, which is overcoated by the charge transport layer 5, is determined by an optical absorption coefficient of the charge generation material and is generally 5 μm or less, preferably 1 μm or less.

The charge transport material can be a hydrazone compound, a butadiene compound, a diamine compound, an indole compound, an indoline compound, a stilbene compound, or a distilbene compound, which can be employed singly or in a suitable combination. Specific examples include compounds described in JP-A-2002-131938. The resinous binder can be, for example, a polycarbonate resin such as of bisphenol-A type, bisphenol-Z type or a bisphenol-A-biphenyl copolymer, a polystyrene resin or a polyphenylene, which can be employed singly or in a suitable combination. Specific examples include compounds described in JP-A-2002-131938. An amount of use of such compounds is 20 to 50 parts by weight of the charge transport material (preferably 3 to 30 parts by weight) to 10 parts by weight of the resinous binder. In order to maintain a practical effective surface potential, the charge transport layer has a film thickness within a range preferably of 3 to 50 μm, more preferably 15 to 40 μm.

An antioxidant, a photostabilizer, etc., may be added to the undercoat layer and the charge transport layer, if necessary, for the purpose of improving environmental resistance and stability against harmful light.

An amount of such antioxidant or photostabilizer is usually 0.05 to 10 parts by weight (preferably 0.2 to 5 parts by weight) to 100 parts by weight of the charge transport material.

Also, there may be added to the photosensitive layer a leveling agent such as a silicone oil or a fluorinated oil, for the purposes of improving a leveling property of the formed film and improving a lubricating property.

(Measurement of Reflectance)

In the following description, reflectance means a ratio in percentage (%) of a surface reflectance of a measured object, with respect to a reference reflectance which is a surface reflectance of a mirror-surface substrate (a reference object).

Figure 16:
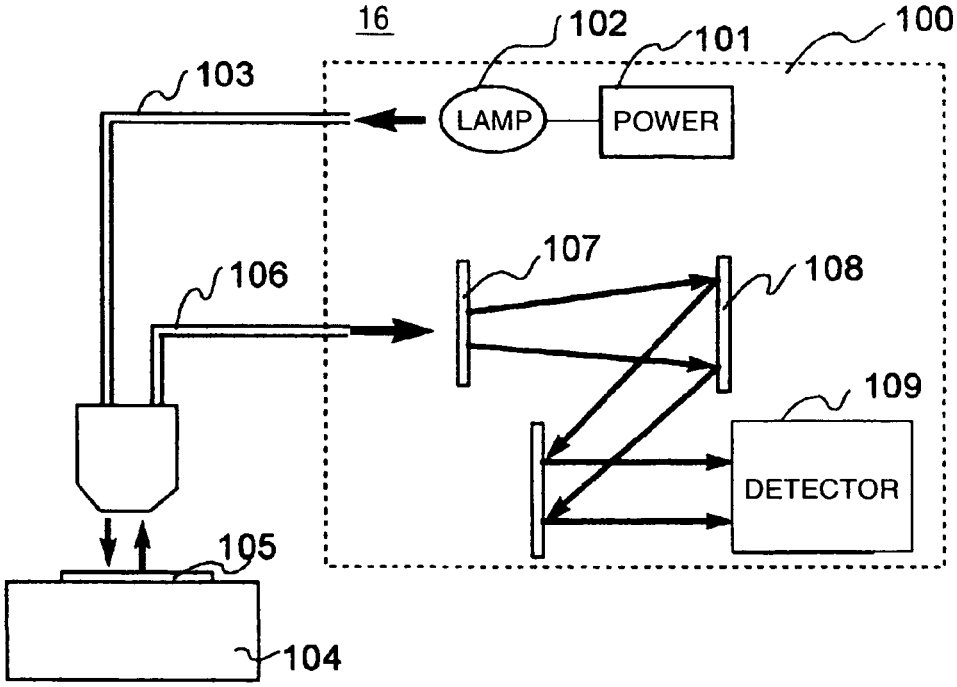
FIG. 16 is a schematic view of a reflectance measuring apparatus for an electrophotographic photosensitive member.

FIG. 16 shows a reflectance measuring apparatus 16 to be used for measuring the reflectance, which will be briefly explained in the following. Light emitted from a halogen lamp 102, provided with a power source 101, is transmitted through an optical fiber tube 103, and irradiates a measured object formed by a measured substrate 104 and a thin film 105 formed thereon. An optical interference is generated between the incident light and reflected light from the substrate surface. The light involving interference is guided through an optical fiber tube 106 for the reflected light and returns to a main body 100 of the apparatus (indicated by a broken-line frame). In the main body 100, the reflected light passes through a slit 107 and is reflected by a mirror 108 having a diffraction grating. The light separated therein is detected by a detector 109. The detected light is converted into an electrical signal, which is supplied through an amplifier (not shown) to a personal computer and outputted after a data processing therein. In the experiments of the invention, a mirror-surface reference plain pipe or a sample of photosensitive member to be explained later is placed as the measured object.

A procedure for measuring the reflectance by the reflectance measuring apparatus 16 is as follows:

1) A measurement is made in a state where the power source 101 is turned off and the slit is closed, to obtain a result $I_{dark}$;
2) A surface reflectance $I_{ref}$ (reference reflectance) on the reference object at a wavelength λ is measured; and
3) A surface reflectance $I_0$ on a measured object at a wavelength λ is measured.

As the surface reflectance $I_0$ measured by the apparatus 16 includes $I_{ref}$ and $I_{dark}$, a reflectance $I_1$ of the measured object excluding these factors can be obtained from a following equation (3). In the following, this equation is utilized for calculating reflectances ($I_{opc}$, $I_{sb}$, $I_{ucl}$):

$$I_1 = \frac{I_0 - I_{dark}}{I_{ref} - I_{dark}} \times 100(\%) \tag{3}$$

A mirror-surface treated plain pipe was used as the reference object measured in the foregoing step 2). This reference mirror-surface plain pipe was surface treated to an average roughness of 0.01-0.03 μm and a maximum roughness $R_{max}$ of 0.1-0.3 μm according to the JIS standard (preparation of electrophotographic photosensitive members for experiment for judging presence/absence of interference fringes, image evaluation and experiment for evaluating electrophotographic characteristics).

Samples of electrophotographic photosensitive members for experiments were prepared with layer structures shown in Examples 1-54 and Comparative Examples 1-54. Principal preparing conditions are dividedly shown in Tables 1-3. The names "Examples" and "Comparative Examples" are merely given for the convenience of detailed description of the invention and have no important meanings.

An experiment relating to the interference fringe judging method of a first aspect of the invention relates to all of Examples 1-54 and Comparative Examples 1-54. Tables 1-3 show layer structures of the photosensitive members prepared in Examples and Comparative Examples. Tables 4-6 show results of judgment of presence/absence of the interference fringes through a comparison of a maximum peak value Sp of the power spectrum with a threshold value (10) and electrophotographic characteristics. Tables 7-9 show a rank of interference fringes by visual observation and results of other image evaluations.

The photosensitive member of a third aspect of the invention is a photosensitive member free from interference fringes, to which Examples 4-18, 22-36, 40-54 and Comparative Examples 1-18, and 22-36 belong.

Among Examples 1-54, the photosensitive members of Examples 4-18, 22-36 and 40-54 belong the electrophotographic photosensitive member of the third aspect of the invention, but the photosensitive members of Comparative Examples 1-54 were prepared with specifications not belonging to any of the electrophotographic photosensitive members of the third and fourth aspects of the invention. The term Comparative Example is used merely in this sense. Among the photosensitive members of Examples 1-54, those other than of Examples 1-3, 16-18, 19-21, 34-36, 37-39 and 52-54, namely those of 4-15, 22-23 and 40-41 belong to the fourth aspect of the invention.

In the following there will be explained the samples of the electrophotographic photosensitive members of Examples 1-54 and Comparative Examples 1-54, used for experiments on judging presence/absence of interference fringes, image evaluation, and experiments for evaluating electrophotographic characteristics.

EXAMPLE 1

Surface Roughening of Substrate

A surface of a cylindrical aluminum conductive substrate, employed as the conductive substrate, was sand blasted to form a rough surface having a reflectance $I_{sb}$=13.6%, an average surface roughness Ra (JIS)=0.35 μm and a maximum surface roughness $R_{max}$ (JIS)=2.7 μm. The reflectance $I_{sb}$ is a ratio (%) of a surface reflectance of a roughened substrate and a surface reflectance of a mirror-surface treated plain pipe, and was measured with a reflectance measuring apparatus 16 as shown in FIG. 16, MCPD-200 manufactured by Union Giken Co. The surface roughness was measured by SURFCOM (trade name, manufactured by Tokyo Seimitsu Co.) with a reference length of 0.8 mm and a measuring length of 4 mm.

(Formation of Undercoat Layer)

Then, an undercoat layer is provided on the surface of the conductive substrate roughened by the sand blasting. The undercoat layer is produced by applying a coating liquid prepared by dispersing 1.8 parts by weight of a phenolic resin (MARKALINKA MH-2 (trade name), manufactured by Maruzen Petrochemical Co.), 1.2 parts by weight of a melamine resin (UBAN 20HS (trade name), manufactured by Mitsui Toatsu Chemical Co.) and 7 parts by weight of titanium oxide particles treated with aminosilane in 80 parts by weight of tetrahydrofuran and 20 parts by weight of butanol. The roughened substrate surface is dip coated with the coating liquid and dried for 30 minutes at 145° C. to obtain the undercoat layer with a film thickness of 4.0 μm, and a reflectance $I_{ucl}$=16.0%.

The reflectance $I_{ucl}$, determined by the aforementioned method, is a ratio (%) of a surface reflectance of an undercoat layer formed by coating on a conductive substrate roughened by sand blasting to a surface reflectance of a mirror-surface plain pipe. In the following, there will be explained a purpose of evaluating the reflectance $I_{ucl}$. An undercoat layer coated on a sand blasted conductive substrate, with increase in the film thickness, becomes gradually unable to follow the irregularities of the sand blasted surface, whereby the surface of the UCL (undercoat layer formed by coating, utilizing an organic resin as a resinous binder) becomes smoother with an increase in the film thickness, thereby tending to generate interference fringes. Thus, an increase in the reflective intensity of the incident light to a particular direction by surface smoothing of the undercoat layer is considered as a factor for interference fringe generation. Based on this fact, in addition to the surface reflectance $I_{sb}$ of the conductive substrate roughened by sand blasting, the surface reflectance $I_{ucl}$ of the undercoat layer coated on the surface of the conductive substrate roughened by sand blasting is considered necessary and is employed as an evaluation parameter.

(Formation of Charge Generation Layer)

Then, on the aforementioned undercoat layer, a coating liquid, prepared by dispersing and dissolving 1 part by weight of metal-free phthalocyanine, represented by the chemical formula shown (I) as a charge generation material and 1 part by weight of a polyvinylbutyral resin (S-LEC BM-1 (trade name), manufactured by Sekisui Chemical Co.) as a resinous binder in 98 parts by weight of dichloromethane, was dip coated and dried for 30 minutes at 80° C. to obtain a charge generation layer of a thickness of 0.2 μm.

(I)

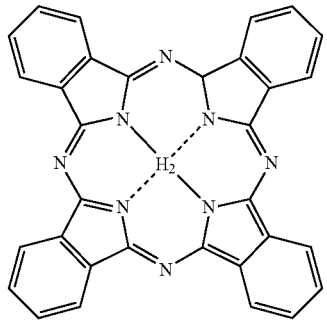

(Formation of Charge Transport Layer)

On the aforementioned charge generation layer, a coating liquid is coated and dried for 60 minutes at 90° C. to obtain a charge transport layer. This coating liquid is prepared by dissolving 9 parts by weight of a stilbene compound represented by the chemical formula (II) as a charge transport material and 11 parts by weight of a polycarbonate resin represented by a following chemical formula (III) as a resinous binder in 110 parts by weight of dichloromethane. By this procedure, a charge transport layer of a thickness of 20 μm is obtained, thereby completing a laminate organic photosensitive member of Example 1.

(II)

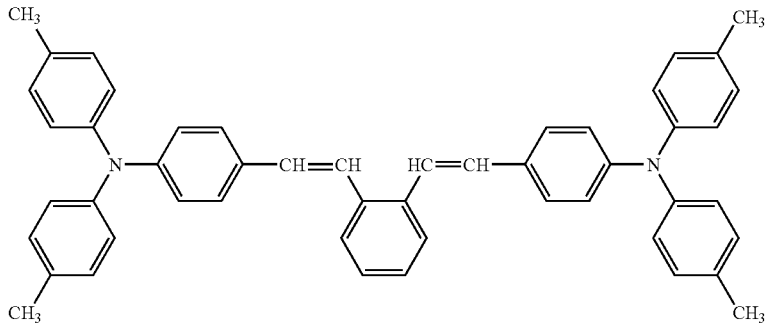

(III)

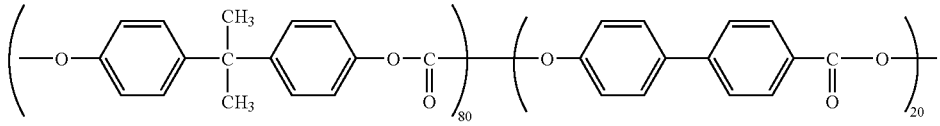

EXAMPLE 2

An organic electrophotographic photosensitive member was prepared in the same manner as in Example 1, except that the charge transport layer employed in Example 1 was changed to a film thickness of 18 μm.

EXAMPLE 3

An organic electrophotographic photosensitive member was prepared in the same manner as in Example 1, except that the charge transport layer employed in Example 1 was changed to a film thickness of 14 μm.

EXAMPLE 4

An organic electrophotographic photosensitive member was prepared in the same manner as in Example 1, except that the undercoat layer employed in Example 1 was changed to a film thickness of 3.5 μm and to a reflectance $I_{ucl}$=15.9%.

EXAMPLE 5

An organic electrophotographic photosensitive member was prepared in the same manner as in Example 4, except that the charge transport layer employed in Example 4 was changed to a film thickness of 18 μm.

EXAMPLE 6

An organic electrophotographic photosensitive member was prepared in the same manner as in Example 4, except that the charge transport layer employed in Example 4 was changed to a film thickness of 14 μm.

EXAMPLE 7

An organic electrophotographic photosensitive member was prepared in the same manner as in Example 1, except that the undercoat layer employed in Example 1 was changed to a film thickness of 3.0 μm and to a reflectance $I_{ucl}$=15.7%.

EXAMPLE 8

An organic electrophotographic photosensitive member was prepared in the same manner as in Example 7, except that the charge transport layer employed in Example 7 was changed to a film thickness of 18 μm.

EXAMPLE 9

An organic electrophotographic photosensitive member was prepared in the same manner as in Example 7, except that the charge transport layer employed in Example 7 was changed to a film thickness of 14 μm.

EXAMPLE 10

An organic electrophotographic photosensitive member was prepared in the same manner as in Example 1, except that the undercoat layer employed in Example 1 was changed to a film thickness of 2.5 μm and to a reflectance $I_{ucl}$=14.9%.

EXAMPLE 11

An organic electrophotographic photosensitive member was prepared in the same manner as in Example 10, except that the charge transport layer employed in Example 10 was changed to a film thickness of 18 μm.

EXAMPLE 12

An organic electrophotographic photosensitive member was prepared in the same manner as in Example 10, except that the charge transport layer employed in Example 10 was changed to a film thickness of 14 μm.

EXAMPLE 13

An organic electrophotographic photosensitive member was prepared in the same manner as in Example 1, except that the undercoat layer employed in Example 1 was changed to a film thickness of 2.0 μm and to a reflectance $I_{ucl}$=14.7%.

EXAMPLE 14

An organic electrophotographic photosensitive member was prepared in the same manner as in Example 13, except that the charge transport layer employed in Example 13 was changed to a film thickness of 18 μm.

EXAMPLE 15

An organic electrophotographic photosensitive member was prepared in the same manner as in Example 13, except that the charge transport layer employed in Example 13 was changed to a film thickness of 14 μm.

EXAMPLE 16

An organic electrophotographic photosensitive member was prepared in the same manner as in Example 1, except that the undercoat layer employed in Example 1 was changed to a film thickness of 1.5 μm and to a reflectance $I_{ucl}$=14.3%.

EXAMPLE 17

An organic electrophotographic photosensitive member was prepared in the same manner as in Example 16, except that the charge transport layer employed in Example 16 was changed to a film thickness of 18 μm.

EXAMPLE 18

An organic electrophotographic photosensitive member was prepared in the same manner as in Example 16, except that the charge transport layer employed in Example 16 was changed to a film thickness of 14 μm.

EXAMPLE 19

An organic electrophotographic photosensitive member was prepared in the same manner as in Example 1, except that the sand blasted conductive substrate was changed to a surface reflectance $I_{sb}$=14.5%, and to a surface roughness of sand blasted irregularities of Ra=0.26 μm and $R_{max}$=2.5 μm, and the undercoat layer was changed to a reflectance $I_{ucl}$=16.5%.

EXAMPLE 20

An organic electrophotographic photosensitive member was prepared in the same manner as in Example 19, except that the charge transport layer employed in Example 19 was changed to a film thickness of 18 μm.

EXAMPLE 21

An organic electrophotographic photosensitive member was prepared in the same manner as in Example 19, except that the charge transport layer employed in Example 19 was changed to a film thickness of 14 μm.

EXAMPLE 22

An organic electrophotographic photosensitive member was prepared in the same manner as in Example 19, except that the undercoat layer employed in Example 19 was changed to a film thickness of 3.5 μm and to a reflectance $I_{ucl}$=16.0%.

EXAMPLE 23

An organic electrophotographic photosensitive member was prepared in the same manner as in Example 22, except that the charge transport layer employed in Example 22 was changed to a film thickness of 18 μm.

EXAMPLE 24

An organic electrophotographic photosensitive member was prepared in the same manner as in Example 22, except that the charge transport layer employed in Example 22 was changed to a film thickness of 14 μm.

EXAMPLE 25

An organic electrophotographic photosensitive member was prepared in the same manner as in Example 19, except that the undercoat layer employed in Example 19 was changed to a film thickness of 3.0 μm and to a reflectance $I_{ucl}$=15.9%.

EXAMPLE 26

An organic electrophotographic photosensitive member was prepared in the same manner as in Example 25, except that the charge transport layer employed in Example 25 was changed to a film thickness of 18 μm.

EXAMPLE 27

An organic electrophotographic photosensitive member was prepared in the same manner as in Example 25, except that the charge transport layer employed in Example 25 was changed to a film thickness of 14 μm.

EXAMPLE 28

An organic electrophotographic photosensitive member was prepared in the same manner as in Example 19, except that the undercoat layer employed in Example 19 was changed to a film thickness of 2.5 μm and to a reflectance $I_{ucl}$=15.7%.

EXAMPLE 29

An organic electrophotographic photosensitive member was prepared in the same manner as in Example 28, except that the charge transport layer employed in Example 28 was changed to a film thickness of 18 μm.

EXAMPLE 30

An organic electrophotographic photosensitive member was prepared in the same manner as in Example 28, except that the charge transport layer employed in Example 28 was changed to a film thickness of 14 μm.

EXAMPLE 31

An organic electrophotographic photosensitive member was prepared in the same manner as in Example 19, except that the undercoat layer employed in Example 19 was changed to a film thickness of 2.0 μm and to a reflectance $I_{ucl}$=15.5%.

EXAMPLE 32

An organic electrophotographic photosensitive member was prepared in the same manner as in Example 31, except that the charge transport layer employed in Example 31 was changed to a film thickness of 18 μm.

EXAMPLE 33

An organic electrophotographic photosensitive member was prepared in the same manner as in Example 31, except that the charge transport layer employed in Example 31 was changed to a film thickness of 14 μm.

EXAMPLE 34

An organic electrophotographic photosensitive member was prepared in the same manner as in Example 19, except that the undercoat layer employed in Example 19 was changed to a film thickness of 1.5 μm and to a reflectance $I_{ucl}$=15.0%.

EXAMPLE 35

An organic electrophotographic photosensitive member was prepared in the same manner as in Example 34, except that the charge transport layer employed in Example 34 was changed to a film thickness of 18 μm.

EXAMPLE 36

An organic electrophotographic photosensitive member was prepared in the same manner as in Example 34, except that the charge transport layer employed in Example 34 was changed to a film thickness of 14 μm.

EXAMPLE 37

An organic electrophotographic photosensitive member was prepared in the same manner as in Example 1, except that the sand blasted conductive substrate was changed to a surface reflectance $I_{sb}$=15%, and to a surface roughness of sand blasted irregularities of Ra=0.23 μm and $R_{max}$=2.4 μm, and the undercoat layer was changed to a reflectance $I_{ucl}$=16.8%.

EXAMPLE 38

An organic electrophotographic photosensitive member was prepared in the same manner as in Example 37, except that the charge transport layer employed in Example 37 was changed to a film thickness of 18 μm.

EXAMPLE 39

An organic electrophotographic photosensitive member was prepared in the same manner as in Example 37, except that the charge transport layer employed in Example 37 was changed to a film thickness of 14 μm.

EXAMPLE 40

An organic electrophotographic photosensitive member was prepared in the same manner as in Example 37, except that the undercoat layer employed in Example 37 was changed to a film thickness of 3.5 μm and to a reflectance $I_{ucl}$=16.5%.

EXAMPLE 41

An organic electrophotographic photosensitive member was prepared in the same manner as in Example 40, except that the charge transport layer employed in Example 40 was changed to a film thickness of 18 μm.

EXAMPLE 42

An organic electrophotographic photosensitive member was prepared in the same manner as in Example 40, except that the charge transport layer employed in Example 40 was changed to a film thickness of 14 μm.

EXAMPLE 43

An organic electrophotographic photosensitive member was prepared in the same manner as in Example 37, except that the undercoat layer employed in Example 37 was changed to a film thickness of 3.0 μm and to a reflectance $I_{ucl}$=16.2%.

EXAMPLE 44

An organic electrophotographic photosensitive member was prepared in the same manner as in Example 43, except that the charge transport layer employed in Example 43 was changed to a film thickness of 18 μm.

EXAMPLE 45

An organic electrophotographic photosensitive member was prepared in the same manner as in Example 43, except that the charge transport layer employed in Example 43 was changed to a film thickness of 14 μm.

EXAMPLE 46

An organic electrophotographic photosensitive member was prepared in the same manner as in Example 37, except that the undercoat layer employed in Example 37 was changed to a film thickness of 2.5 μm and to a reflectance $I_{ucl}$=15.4%.

EXAMPLE 47

An organic electrophotographic photosensitive member was prepared in the same manner as in Example 46, except that the charge transport layer employed in Example 46 was changed to a film thickness of 18 μm.

EXAMPLE 48

An organic electrophotographic photosensitive member was prepared in the same manner as in Example 46, except that the charge transport layer employed in Example 46 was changed to a film thickness of 14 μm.

EXAMPLE 49

An organic electrophotographic photosensitive member was prepared in the same manner as in Example 37, except that the undercoat layer employed in Example 37 was changed to a film thickness of 2.0 μm and to a reflectance $I_{ucl}$=14.9%.

EXAMPLE 50

An organic electrophotographic photosensitive member was prepared in the same manner as in Example 49, except that the charge transport layer employed in Example 49 was changed to a film thickness of 18 μm.

EXAMPLE 51

An organic electrophotographic photosensitive member was prepared in the same manner as in Example 49, except that the charge transport layer employed in Example 49 was changed to a film thickness of 14 μm.

EXAMPLE 52

An organic electrophotographic photosensitive member was prepared in the same manner as in Example 37, except that the undercoat layer employed in Example 37 was changed to a film thickness of 1.5 μm and to a reflectance $I_{ucl}$=14.6%.

EXAMPLE 53

An organic electrophotographic photosensitive member was prepared in the same manner as in Example 52, except that the charge transport layer employed in Example 52 was changed to a film thickness of 18 μm.

EXAMPLE 54

An organic electrophotographic photosensitive member was prepared in the same manner as in Example 52, except that the charge transport layer employed in Example 52 was changed to a film thickness of 14 μm.

COMPARATIVE EXAMPLE 1

An organic electrophotographic photosensitive member was prepared in the same manner as in Example 1, except that a sand blasting condition employed in Example 1 was so changed as to obtain, in the sand blasted conductive substrate, a surface reflectance $I_{sb}$=10.4%, and a surface roughness of sand blasted irregularities of Ra=0.57 μm and $R_{max}$=4.5 μm, and the undercoat layer was changed to a reflectance $I_{ucl}$=12.5%.

COMPARATIVE EXAMPLE 2

An organic electrophotographic photosensitive member was prepared in the same manner as in Comparative Example 1, except that the charge transport layer employed in Comparative Example 1 was changed to a film thickness of 18 μm.

COMPARATIVE EXAMPLE 3

An organic electrophotographic photosensitive member was prepared in the same manner as in Comparative Example 1, except that the charge transport layer employed in Comparative Example 1 was changed to a film thickness of 14 μm.

COMPARATIVE EXAMPLE 4

An organic electrophotographic photosensitive member was prepared in the same manner as in Comparative Example 1, except that the undercoat layer employed in Comparative Example 1 was changed to a film thickness of 3.5 μm and to a reflectance $I_{ucl}$=12.3%.

COMPARATIVE EXAMPLE 5

An organic electrophotographic photosensitive member was prepared in the same manner as in Comparative Example 4, except that the charge transport layer employed in Comparative Example 4 was changed to a film thickness of 18 μm.

COMPARATIVE EXAMPLE 6

An organic electrophotographic photosensitive member was prepared in the same manner as in Comparative Example 4, except that the charge transport layer employed in Comparative Example 4 was changed to a film thickness of 14 μm.

COMPARATIVE EXAMPLE 7

An organic electrophotographic photosensitive member was prepared in the same manner as in Comparative Example 1, except that the undercoat layer employed in Comparative Example 1 was changed to a film thickness of 3.0 μm and to a reflectance $I_{ucl}$=12.1%.

COMPARATIVE EXAMPLE 8

An organic electrophotographic photosensitive member was prepared in the same manner as in Comparative Example 7, except that the charge transport layer employed in Comparative Example 7 was changed to a film thickness of 18 μm.

COMPARATIVE EXAMPLE 9

An organic electrophotographic photosensitive member was prepared in the same manner as in Comparative Example 7, except that the charge transport layer employed in Comparative Example 7 was changed to a film thickness of 14 μm.

COMPARATIVE EXAMPLE 10

An organic electrophotographic photosensitive member was prepared in the same manner as in Comparative Example 1, except that the undercoat layer employed in Comparative Example 1 was changed to a film thickness of 2.5 μm and to a reflectance $I_{ucl}$=11.9%.

COMPARATIVE EXAMPLE 11

An organic electrophotographic photosensitive member was prepared in the same manner as in Comparative Example 10, except that the charge transport layer employed in Comparative Example 10 was changed to a film thickness of 18 μm.

COMPARATIVE EXAMPLE 12

An organic electrophotographic photosensitive member was prepared in the same manner as in Comparative Example 10, except that the charge transport layer employed in Comparative Example 10 was changed to a film thickness of 14 μm.

COMPARATIVE EXAMPLE 13

An organic electrophotographic photosensitive member was prepared in the same manner as in Comparative Example 1, except that the undercoat layer employed in Comparative Example 1 was changed to a film thickness of 2.0 μm and to a reflectance $I_{ucl}$=11.6%.

COMPARATIVE EXAMPLE 14

An organic electrophotographic photosensitive member was prepared in the same manner as in Comparative Example 13, except that the charge transport layer employed in Comparative Example 13 was changed to a film thickness of 18 μm.

COMPARATIVE EXAMPLE 15

An organic electrophotographic photosensitive member was prepared in the same manner as in Comparative Example 13, except that the charge transport layer employed in Comparative Example 13 was changed to a film thickness of 14 μm.

COMPARATIVE EXAMPLE 16

An organic electrophotographic photosensitive member was prepared in the same manner as in Comparative Example 1, except that the undercoat layer employed in Comparative Example 1 was changed to a film thickness of 1.5 μm and to a reflectance $I_{ucl}$=11.3%.

COMPARATIVE EXAMPLE 17

An organic electrophotographic photosensitive member was prepared in the same manner as in Comparative Example 16, except that the charge transport layer employed in Comparative Example 16 was changed to a film thickness of 18 μm.

COMPARATIVE EXAMPLE 18

An organic electrophotographic photosensitive member was prepared in the same manner as in Comparative Example 16, except that the charge transport layer employed in Comparative Example 16 was changed to a film thickness of 14 μm.

COMPARATIVE EXAMPLE 19

An organic electrophotographic photosensitive member was prepared in the same manner as in Example 1, except that a sand blasting condition employed in Example 1 was so changed as to obtain, in the sand blasted conductive substrate, a surface reflectance $I_{sb}$=12.9%, and a surface roughness of sand blasted irregularities of Ra=0.39 μm and $R_{max}$=3.4 μm, and the undercoat layer was changed to a reflectance $I_{ucl}$=14.9%.

COMPARATIVE EXAMPLE 20

An organic electrophotographic photosensitive member was prepared in the same manner as in Comparative Example 19, except that the charge transport layer employed in Comparative Example 19 was changed to a film thickness of 18 μm.

COMPARATIVE EXAMPLE 21

An organic electrophotographic photosensitive member was prepared in the same manner as in Comparative Example 19, except that the charge transport layer employed in Comparative Example 19 was changed to a film thickness of 14 μm.

COMPARATIVE EXAMPLE 22

An organic electrophotographic photosensitive member was prepared in the same manner as in Comparative Example 19, except that the undercoat layer employed in Comparative Example 19 was changed to a film thickness of 3.5 μm and to a reflectance $I_{ucl}$=14.6%.

COMPARATIVE EXAMPLE 23

An organic electrophotographic photosensitive member was prepared in the same manner as in Comparative Example 22, except that the charge transport layer employed in Comparative Example 22 was changed to a film thickness of 18 μm.

COMPARATIVE EXAMPLE 24

An organic electrophotographic photosensitive member was prepared in the same manner as in Comparative Example 22, except that the charge transport layer employed in Comparative Example 22 was changed to a film thickness of 14 μm.

COMPARATIVE EXAMPLE 25

An organic electrophotographic photosensitive member was prepared in the same manner as in Comparative Example 19, except that the undercoat layer employed in Comparative Example 19 was changed to a film thickness of 3.0 μm and to a reflectance $I_{ucl}$=14.3%.

COMPARATIVE EXAMPLE 26

An organic electrophotographic photosensitive member was prepared in the same manner as in Comparative Example 25, except that the charge transport layer employed in Comparative Example 25 was changed to a film thickness of 18 μm.

COMPARATIVE EXAMPLE 27

An organic electrophotographic photosensitive member was prepared in the same manner as in Comparative Example 25, except that the charge transport layer employed in Comparative Example 25 was changed to a film thickness of 14 μm.

COMPARATIVE EXAMPLE 28

An organic electrophotographic photosensitive member was prepared in the same manner as in Comparative Example 19, except that the undercoat layer employed in Comparative Example 19 was changed to a film thickness of 2.5 μm and to a reflectance $I_{ucl}$=14.0%.

COMPARATIVE EXAMPLE 29

An organic electrophotographic photosensitive member was prepared in the same manner as in Comparative Example 28, except that the charge transport layer employed in Comparative Example 28 was changed to a film thickness of 18 μm.

COMPARATIVE EXAMPLE 30

An organic electrophotographic photosensitive member was prepared in the same manner as in Comparative Example 28, except that the charge transport layer employed in Comparative Example 28 was changed to a film thickness of 14 μm.

COMPARATIVE EXAMPLE 31

An organic electrophotographic photosensitive member was prepared in the same manner as in Comparative Example 19, except that the undercoat layer employed in Comparative Example 19 was changed to a film thickness of 2.0 μm and to a reflectance $I_{ucl}$=13.3%.

COMPARATIVE EXAMPLE 32

An organic electrophotographic photosensitive member was prepared in the same manner as in Comparative Example 31, except that the charge transport layer employed in Comparative Example 31 was changed to a film thickness of 18 μm.

COMPARATIVE EXAMPLE 33

An organic electrophotographic photosensitive member was prepared in the same manner as in Comparative Example 31, except that the charge transport layer employed in Comparative Example 31 was changed to a film thickness of 14 μm.

COMPARATIVE EXAMPLE 34

An organic electrophotographic photosensitive member was prepared in the same manner as in Comparative Example 19, except that the undercoat layer employed in Comparative Example 19 was changed to a film thickness of 1.5 μm and to a reflectance $I_{ucl}$=12.9%.

COMPARATIVE EXAMPLE 35

An organic electrophotographic photosensitive member was prepared in the same manner as in Comparative Example 34, except that the charge transport layer employed in Comparative Example 34 was changed to a film thickness of 18 μm.

COMPARATIVE EXAMPLE 36

An organic electrophotographic photosensitive member was prepared in the same manner as in Comparative Example 34, except that the charge transport layer employed in Comparative Example 34 was changed to a film thickness of 14 μm.

COMPARATIVE EXAMPLE 37

An organic electrophotographic photosensitive member was prepared in the same manner as in Example 1, except that a sand blasting condition employed in Example 1 was so changed as to obtain, in the sand blasted conductive substrate, a surface reflectance $I_{sb}$=17%, and a surface roughness of sand blasted irregularities of Ra=0.18 μm and $R_{max}$=2.2 μm, and the undercoat layer was changed to a reflectance $I_{ucl}$=17.9%.

COMPARATIVE EXAMPLE 38

An organic electrophotographic photosensitive member was prepared in the same manner as in Comparative Example 37, except that the charge transport layer employed in Comparative Example 37 was changed to a film thickness of 18 μm.

COMPARATIVE EXAMPLE 39

An organic electrophotographic photosensitive member was prepared in the same manner as in Comparative Example 37, except that the charge transport layer employed in Comparative Example 37 was changed to a film thickness of 14 μm.

COMPARATIVE EXAMPLE 40

An organic electrophotographic photosensitive member was prepared in the same manner as in Comparative Example 37, except that the undercoat layer employed in Comparative Example 37 was changed to a film thickness of 3.5 μm and to a reflectance $I_{ucl}$=17.5%.

COMPARATIVE EXAMPLE 41

An organic electrophotographic photosensitive member was prepared in the same manner as in Comparative Example 40, except that the charge transport layer employed in Comparative Example 40 was changed to a film thickness of 18 μm.

COMPARATIVE EXAMPLE 42

An organic electrophotographic photosensitive member was prepared in the same manner as in Comparative Example 40, except that the charge transport layer employed in Comparative Example 40 was changed to a film thickness of 14 μm.

COMPARATIVE EXAMPLE 43

An organic electrophotographic photosensitive member was prepared in the same manner as in Comparative Example 37, except that the undercoat layer employed in Comparative Example 37 was changed to a film thickness of 3.0 μm and to a reflectance $I_{ucl}$=16.8%.

COMPARATIVE EXAMPLE 44

An organic electrophotographic photosensitive member was prepared in the same manner as in Comparative Example 43, except that the charge transport layer employed in Comparative Example 43 was changed to a film thickness of 18 μm.

COMPARATIVE EXAMPLE 45

An organic electrophotographic photosensitive member was prepared in the same manner as in Comparative Example 43, except that the charge transport layer employed in Comparative Example 43 was changed to a film thickness of 14 μm.

COMPARATIVE EXAMPLE 46

An organic electrophotographic photosensitive member was prepared in the same manner as in Comparative Example 37, except that the undercoat layer employed in Comparative Example 37 was changed to a film thickness of 2.5 μm and to a reflectance Iucl=16.0%.

COMPARATIVE EXAMPLE 47

An organic electrophotographic photosensitive member was prepared in the same manner as in Comparative Example 46, except that the charge transport layer employed in Comparative Example 46 was changed to a film thickness of 18 μm.

COMPARATIVE EXAMPLE 48

An organic electrophotographic photosensitive member was prepared in the same manner as in Comparative Example 46, except that the charge transport layer employed in Comparative Example 46 was changed to a film thickness of 14 μm.

COMPARATIVE EXAMPLE 49

An organic electrophotographic photosensitive member was prepared in the same manner as in Comparative Example 37, except that the undercoat layer employed in Comparative Example 37 was changed to a film thickness of 2.0 μm and to a reflectance $I_{ucl}$=15.4%.

COMPARATIVE EXAMPLE 50

An organic electrophotographic photosensitive member was prepared in the same manner as in Comparative Example 49, except that the charge transport layer employed in Comparative Example 49 was changed to a film thickness of 18 μm.

COMPARATIVE EXAMPLE 51

An organic electrophotographic photosensitive member was prepared in the same manner as in Comparative Example 49, except that the charge transport layer employed in Comparative Example 49 was changed to a film thickness of 14 μm.

COMPARATIVE EXAMPLE 52

An organic electrophotographic photosensitive member was prepared in the same manner as in Comparative Example 37, except that the undercoat layer employed in Comparative Example 37 was changed to a film thickness of 1.5 μm and to a reflectance Iucl=15.0%.

COMPARATIVE EXAMPLE 53

An organic electrophotographic photosensitive member was prepared in the same manner as in Comparative Example 52, except that the charge transport layer employed in Comparative Example 52 was changed to a film thickness of 18 μm.

COMPARATIVE EXAMPLE 54

An organic electrophotographic photosensitive member was prepared in the same manner as in Comparative Example 52, except that the charge transport layer employed in Comparative Example 52 was changed to a film thickness of 14 μm.

Conditions of preparation of the foregoing Examples 1-54 and Comparative Examples 1-54 are summarized in Tables 1-3.

Evaluation of Samples of Photosensitive Members in Examples 1-54 and Comparative Examples 1-54

On the photosensitive members of Examples 1-54 and Comparative Examples 1-54, electrophotographic characteristics (shown in Tables 4-6) were evaluated in the following manner.

After a photosensitive member was charged to −800 V in a dark place, a retention rate $Vk_1$ after 1 second of a surface potential of the drum, in a state where the drum rotation is stopped, was determined. Subsequently, the surface of the photosensitive member was continuously irradiated with light, and an exposure amount required for the charged potential to reach −400 V from −800 V was determined as a sensitivity $E_{1/2}$, and an exposure amount required for the charged potential to reach −100 V from −800 V was determined as a sensitivity $E_{100}$. Also in the aforementioned sensitivity measurement, a surface potential of the photosensitive member immediately after an irradiation with exposing light of a total light amount of 5.0 μJ/cm$^2$ was determined as a residual potential $Vr_{50}$.

Subsequently, evaluations were made of a solution (one-dot reproducibility, and fine white line resolution), interference fringes, density unevenness resulting from fine irregularities on the sand blasted surface (hereinafter referred to as "SB irregularity density unevenness"), an OPC (organic photosensitive layer) leak trace, and a stripe-shaped unevenness on an actual apparatus, as shown in Tables 7-9.

The apparatus employed in the evaluations was a commercially available printer, in which a surface of a photosensitive member, contacted by a brush charger, was charged negatively by application of a DC voltage of 1.2 kV to the brush charger, and an electrostatic latent image corresponding to a resolution of 600 dpi was formed by a laser beam emitted by a laser unit, and a print on a paper was obtained through developing and transfer processes. However, the apparatus was not equipped with a charge-eliminating light and cleaning blade.

In the evaluation of resolution, one-dot reproducibility was evaluated by a visual observation of a printed image of a one-dot pattern of 600 dpi, and fine white line resolution was evaluated by a visual observation of an image having a fine white line on a black image.

The interference fringes were evaluated by visual observation of an interference fringe pattern on a halftone image, in five levels with a pitch of 0.5 (the levels running from 0: no interference fringes, to 5: clear and strong generation of interference fringes).

Sand blast (SB) irregularity density unevenness was evaluated by a visual observation of a spot-shaped unevenness on a halftone image, resulting from fine irregularities of the sand blasting, in 5 levels with a pitch of 0.5 (0: no SB irregularity density unevenness, 5: clear and strong generation of SB irregularity density unevenness).

The stripe-shaped unevenness was evaluated in a visual observation by presence/absence of a stripe-shaped unevenness appearing, on a halftone image, at a circumferential cycle of the drum in an axial direction thereof with a width of about 5 mm and having a density higher than the halftone density. Simultaneous with this evaluation, the OPC drum was taken out from a cartridge, and presence/absence of a leak trace on the photosensitive layer was evaluated by a visual observation.

The stripe-shaped unevenness and the OPC (organic photosensitive layer) leak trace were evaluated in two environmental conditions of temperature/humidity=24° C./43% and 35° C./85%, while other evaluations were in one environmental condition of temperature/humidity=24° C./43%.

The results of the above-described preparing conditions, electrophotographic characteristics and image evaluations on the photosensitive members are shown in Tables 1-9.

TABLE 1

| | Layer structure | | | | | | |
|---|---|---|---|---|---|---|---|
| | Roughened conductive substrate | | | | | | |
| | | Surface roughness | | Undercoat layer | | Charge generation layer | Charge transport layer |
| Sample | Reflectance lsb % | Ra | Rmax μm | Film thickness μm | Reflectance lucl % | Film thickness μm | Film thickness μm |
| Example 1 | 13.6 | 0.35 | 2.7 | 4.0 | 16.0 | 0.2 | 20 |
| Example 2 | | | | | | | 18 |
| Example 3 | | | | | | | 14 |
| Example 4 | | | | 3.5 | 15.9 | | 20 |
| Example 5 | | | | | | | 18 |
| Example 6 | | | | | | | 14 |
| Example 7 | | | | 3.0 | 15.7 | | 20 |
| Example 8 | | | | | | | 18 |
| Example 9 | | | | | | | 14 |
| Example 10 | | | | 2.5 | 14.9 | | 20 |
| Example 11 | | | | | | | 18 |
| Example 12 | | | | | | | 14 |
| Example 13 | | | | 2.0 | 14.7 | | 20 |
| Example 14 | | | | | | | 18 |
| Example 15 | | | | | | | 14 |
| Example 16 | | | | 1.5 | 14.3 | | 20 |
| Example 17 | | | | | | | 18 |
| Example 18 | | | | | | | 14 |
| Example 19 | 14.5 | 0.26 | 2.5 | 4.0 | 16.5 | | 20 |
| Example 20 | | | | | | | 18 |
| Example 21 | | | | | | | 14 |
| Example 22 | | | | 3.5 | 16.0 | | 20 |
| Example 23 | | | | | | | 18 |
| Example 24 | | | | | | | 14 |
| Example 25 | | | | 3.0 | 15.9 | | 20 |
| Example 26 | | | | | | | 18 |
| Example 27 | | | | | | | 14 |
| Example 28 | | | | 2.5 | 15.7 | | 20 |
| Example 29 | | | | | | | 18 |
| Example 30 | | | | | | | 14 |
| Example 31 | | | | 2.0 | 15.5 | | 20 |
| Example 32 | | | | | | | 18 |
| Example 33 | | | | | | | 14 |
| Example 34 | | | | 1.5 | 15.0 | | 20 |
| Example 35 | | | | | | | 18 |
| Example 36 | | | | | | | 14 |

TABLE 2

| | Layer structure | | | | | | |
|---|---|---|---|---|---|---|---|
| | Roughened conductive substrate | | | | | | |
| | | Surface roughness | | Undercoat layer | | Charge generation layer | Charge transport layer |
| Sample | Reflectance lsb % | Ra | Rmax μm | Film thickness μm | Reflectance lucl % | Film thickness μm | Film thickness μm |
| Example 37 | 15 | 0.23 | 2.4 | 4.0 | 16.8 | 0.2 | 20 |
| Example 38 | | | | | | | 18 |
| Example 39 | | | | | | | 14 |
| Example 40 | | | | 3.5 | 16.5 | | 20 |
| Example 41 | | | | | | | 18 |
| Example 42 | | | | | | | 14 |
| Example 43 | | | | 3.0 | 16.2 | | 20 |
| Example 44 | | | | | | | 18 |
| Example 45 | | | | | | | 14 |
| Example 46 | | | | 2.5 | 15.4 | | 20 |
| Example 47 | | | | | | | 18 |
| Example 48 | | | | | | | 14 |
| Example 49 | | | | 2.0 | 14.9 | | 20 |
| Example 50 | | | | | | | 18 |
| Example 51 | | | | | | | 14 |
| Example 52 | | | | 1.5 | 14.6 | | 20 |

TABLE 2-continued

| | Layer structure | | | | | | |
|---|---|---|---|---|---|---|---|
| | Roughened conductive substrate | | | | | | |
| | | Surface roughness | | Undercoat layer | | Charge generation layer | Charge transport layer |
| Sample | Reflectance lsb % | Ra | Rmax μm | Film thickness μm | Reflectance lucl % | Film thickness μm | Film thickness μm |
| Example 53 | | | | | | | 18 |
| Example 54 | | | | | | | 14 |
| Comparative Example 1 | 10.4 | 0.57 | 4.5 | 4.0 | 12.5 | | 20 |
| Comparative Example 2 | | | | | | | 18 |
| Comparative Example 3 | | | | | | | 14 |
| Comparative Example 4 | | | | 3.5 | 12.3 | | 20 |
| Comparative Example 5 | | | | | | | 18 |
| Comparative Example 6 | | | | | | | 14 |
| Comparative Example 7 | | | | 3.0 | 12.1 | | 20 |
| Comparative Example 8 | | | | | | | 18 |
| Comparative Example 9 | | | | | | | 14 |
| Comparative Example 10 | | | | 2.5 | 11.9 | | 20 |
| Comparative Example 11 | | | | | | | 18 |
| Comparative Example 12 | | | | | | | 14 |
| Comparative Example 13 | | | | 2.0 | 11.6 | | 20 |
| Comparative Example 14 | | | | | | | 18 |
| Comparative Example 15 | | | | | | | 14 |
| Comparative Example 16 | | | | 1.5 | 11.3 | | 20 |
| Comparative Example 17 | | | | | | | 18 |
| Comparative Example 18 | | | | | | | 14 |

TABLE 3

| | Layer structure | | | | | | |
|---|---|---|---|---|---|---|---|
| | Roughened conductive substrate | | | | | | |
| | | Surface roughness | | Undercoat layer | | Charge generation layer | Charge transport layer |
| Sample | Reflectance lsb % | Ra | Rmax μm | Film thickness μm | Reflectance lucl % | Film thickness μm | Film thickness μm |
| Comparative Example 19 | 12.9 | 0.39 | 3.4 | 4.0 | 14.9 | 0.2 | 20 |
| Comparative Example 20 | | | | | | | 18 |
| Comparative Example 21 | | | | | | | 14 |
| Comparative Example 22 | | | | 3.5 | 14.6 | | 20 |
| Comparative Example 23 | | | | | | | 18 |
| Comparative Example 24 | | | | | | | 14 |
| Comparative Example 25 | | | | 3.0 | 14.3 | | 20 |
| Comparative Example 26 | | | | | | | 18 |
| Comparative Example 27 | | | | | | | 14 |
| Comparative Example 28 | | | | 2.5 | 14.0 | | 20 |
| Comparative Example 29 | | | | | | | 18 |
| Comparative Example 30 | | | | | | | 14 |
| Comparative Example 31 | | | | 2.0 | 13.3 | | 20 |
| Comparative Example 32 | | | | | | | 18 |
| Comparative Example 33 | | | | | | | 14 |
| Comparative Example 34 | | | | 1.5 | 12.9 | | 20 |
| Comparative Example 35 | | | | | | | 18 |
| Comparative Example 36 | | | | | | | 14 |
| Comparative Example 37 | 17 | 0.18 | 2.2 | 4.0 | 17.9 | | 20 |
| Comparative Example 38 | | | | | | | 18 |
| Comparative Example 39 | | | | | | | 14 |
| Comparative Example 40 | | | | 3.5 | 17.5 | | 20 |
| Comparative Example 41 | | | | | | | 18 |
| Comparative Example 42 | | | | | | | 14 |
| Comparative Example 43 | | | | 3.0 | 16.8 | | 20 |
| Comparative Example 44 | | | | | | | 18 |
| Comparative Example 45 | | | | | | | 14 |
| Comparative Example 46 | | | | 2.5 | 16.0 | | 20 |
| Comparative Example 47 | | | | | | | 18 |
| Comparative Example 48 | | | | | | | 14 |
| Comparative Example 49 | | | | 2.0 | 15.4 | | 20 |
| Comparative Example 50 | | | | | | | 18 |

TABLE 3-continued

| | Layer structure | | | | | | |
|---|---|---|---|---|---|---|---|
| | Roughened conductive substrate | | | | | | |
| | | Surface roughness | | Undercoat layer | | Charge generation layer | Charge transport layer |
| Sample | Reflectance lsb % | Ra | Rmax µm | Film thickness µm | Reflectance lucl % | Film thickness µm | Film thickness µm |
| Comparative Example 51 | | | | | | | 14 |
| Comparative Example 52 | | | | 1.5 | 15.0 | | 20 |
| Comparative Example 53 | | | | | | | 18 |
| Comparative Example 54 | | | | | | | 14 |

TABLE 4

| | | Electrophotographic characteristics charging voltage = −800 V | | | |
|---|---|---|---|---|---|
| Sample | Presence/absence of interference fringes by power spectrum | Retention rate after 1 second $Vk_1$ % | Sensitivity $E_{1/2}$ µJ/cm$^2$ | Sensitivity $E_{100}$ µJ/cm$^2$ | Residual potential VR5.0 V |
| Example 1 | present | 93.5 | 0.20 | 0.56 | 23 |
| Example 2 | present | 93.3 | 0.24 | 0.59 | 22 |
| Example 3 | present | 91.6 | 0.27 | 0.66 | 21 |
| Example 4 | absent | 93.7 | 0.21 | 0.57 | 23 |
| Example 5 | absent | 93.4 | 0.24 | 0.59 | 22 |
| Example 6 | absent | 91.7 | 0.27 | 0.66 | 22 |
| Example 7 | absent | 93.8 | 0.21 | 0.56 | 23 |
| Example 8 | absent | 93.4 | 0.24 | 0.59 | 22 |
| Example 9 | absent | 91.8 | 0.27 | 0.66 | 22 |
| Example 10 | absent | 94.1 | 0.22 | 0.57 | 24 |
| Example 11 | absent | 93.8 | 0.24 | 0.60 | 23 |
| Example 12 | absent | 91.7 | 0.27 | 0.66 | 21 |
| Example 13 | absent | 94.0 | 0.22 | 0.56 | 22 |
| Example 14 | absent | 93.6 | 0.24 | 0.60 | 23 |
| Example 15 | absent | 91.8 | 0.26 | 0.65 | 20 |
| Example 16 | absent | 94.3 | 0.22 | 0.56 | 22 |
| Example 17 | absent | 93.7 | 0.24 | 0.60 | 23 |
| Example 18 | absent | 92.0 | 0.26 | 0.65 | 20 |
| Example 19 | present | 94.5 | 0.21 | 0.54 | 21 |
| Example 20 | present | 94.2 | 0.24 | 0.57 | 20 |
| Example 21 | present | 93.0 | 0.25 | 0.63 | 20 |
| Example 22 | absent | 94.8 | 0.22 | 0.55 | 22 |
| Example 23 | absent | 94.4 | 0.24 | 0.58 | 21 |
| Example 24 | absent | 93.3 | 0.25 | 0.64 | 21 |
| Example 25 | absent | 95.3 | 0.22 | 0.55 | 22 |
| Example 26 | absent | 94.6 | 0.24 | 0.58 | 21 |
| Example 27 | absent | 93.4 | 0.26 | 0.64 | 21 |
| Example 28 | absent | 95.2 | 0.22 | 0.55 | 21 |
| Example 29 | absent | 94.8 | 0.24 | 0.59 | 21 |
| Example 30 | absent | 93.9 | 0.26 | 0.64 | 20 |
| Example 31 | absent | 95.3 | 0.23 | 0.58 | 23 |
| Example 32 | absent | 95.1 | 0.24 | 0.59 | 22 |
| Example 33 | absent | 94.2 | 0.27 | 0.65 | 21 |
| Example 34 | absent | 95.4 | 0.23 | 0.57 | 22 |
| Example 35 | absent | 95.0 | 0.24 | 0.60 | 22 |
| Example 36 | absent | 93.7 | 0.27 | 0.65 | 20 |

TABLE 5

| | | Electrophotographic characteristics charging voltage = −800 V | | | |
|---|---|---|---|---|---|
| Sample | Presence/absence of interference fringes by power spectrum | Retention rate after 1 second $Vk_1$ % | Sensitivity $E_{1/2}$ µJ/cm$^2$ | Sensitivity $E_{100}$ µJ/cm$^2$ | Residual potential VR5.0 V |
| Example 37 | present | 94.0 | 0.23 | 0.57 | 26 |
| Example 38 | present | 93.6 | 0.24 | 0.58 | 20 |
| Example 39 | present | 92.3 | 0.26 | 0.64 | 20 |
| Example 40 | absent | 94.4 | 0.23 | 0.58 | 25 |

TABLE 5-continued

| Sample | Presence/absence of interference fringes by power spectrum | Electrophotographic characteristics charging voltage = −800 V | | | |
|---|---|---|---|---|---|
| | | Retention rate after 1 second $Vk_1$ % | Sensitivity $E_{1/2}$ μJ/cm$^2$ | Sensitivity $E_{100}$ μJ/cm$^2$ | Residual potential VR5.0 V |
| Example 41 | absent | 94.0 | 0.24 | 0.59 | 21 |
| Example 42 | absent | 92.6 | 0.26 | 0.64 | 21 |
| Example 43 | absent | 94.7 | 0.23 | 0.59 | 25 |
| Example 44 | absent | 94.3 | 0.24 | 0.59 | 21 |
| Example 45 | absent | 93.0 | 0.26 | 0.64 | 20 |
| Example 46 | absent | 94.9 | 0.22 | 0.57 | 24 |
| Example 47 | absent | 94.5 | 0.24 | 0.59 | 22 |
| Example 48 | absent | 93.3 | 0.26 | 0.65 | 22 |
| Example 49 | absent | 94.9 | 0.23 | 0.58 | 24 |
| Example 50 | absent | 94.5 | 0.24 | 0.60 | 22 |
| Example 51 | absent | 93.4 | 0.26 | 0.64 | 22 |
| Example 52 | absent | 94.9 | 0.23 | 0.58 | 24 |
| Example 53 | absent | 94.6 | 0.24 | 0.59 | 22 |
| Example 54 | absent | 93.5 | 0.26 | 0.65 | 22 |
| Comparative Example 1 | absent | 90.3 | 0.21 | 0.57 | 24 |
| Comparative Example 2 | absent | 89.2 | 0.21 | 0.59 | 20 |
| Comparative Example 3 | absent | 85.9 | 0.24 | 0.64 | 19 |
| Comparative Example 4 | absent | 90.8 | 0.20 | 0.56 | 23 |
| Comparative Example 5 | absent | 89.4 | 0.21 | 0.58 | 19 |
| Comparative Example 6 | absent | 86.0 | 0.24 | 0.63 | 18 |
| Comparative Example 7 | absent | 91.1 | 0.20 | 0.56 | 22 |
| Comparative Example 8 | absent | 89.6 | 0.21 | 0.57 | 19 |
| Comparative Example 9 | absent | 86.2 | 0.24 | 0.63 | 18 |
| Comparative Example 10 | absent | 91.3 | 0.20 | 0.55 | 21 |
| Comparative Example 11 | absent | 89.8 | 0.22 | 0.58 | 19 |
| Comparative Example 12 | absent | 87.0 | 0.24 | 0.62 | 18 |
| Comparative Example 13 | absent | 90.9 | 0.20 | 0.54 | 20 |
| Comparative Example 14 | absent | 90.3 | 0.22 | 0.57 | 19 |
| Comparative Example 15 | absent | 86.6 | 0.24 | 0.63 | 19 |
| Comparative Example 16 | absent | 91.9 | 0.20 | 0.54 | 21 |
| Comparative Example 17 | absent | 90.2 | 0.22 | 0.57 | 19 |
| Comparative Example 18 | absent | 86.3 | 0.24 | 0.62 | 18 |

TABLE 6

| Sample | Presence/absence of interference fringes by power spectrum | Electrophotographic characteristics charging voltage = −800 V | | | |
|---|---|---|---|---|---|
| | | Retention rate after 1 second $Vk_1$ % | Sensitivity $E_{1/2}$ μJ/cm$^2$ | Sensitivity $E_{100}$ μJ/cm$^2$ | Residual potential VR5.0 V |
| Comparative Example 19 | present | 92.0 | 0.21 | 0.52 | 17 |
| Comparative Example 20 | present | 92.0 | 0.22 | 0.55 | 19 |
| Comparative Example 21 | present | 90.0 | 0.24 | 0.62 | 19 |
| Comparative Example 22 | absent | 92.5 | 0.21 | 0.53 | 18 |
| Comparative Example 23 | absent | 92.4 | 0.22 | 0.56 | 20 |
| Comparative Example 24 | absent | 90.8 | 0.25 | 0.63 | 20 |
| Comparative Example 25 | absent | 93.0 | 0.21 | 0.53 | 18 |
| Comparative Example 26 | absent | 93.0 | 0.22 | 0.56 | 20 |
| Comparative Example 27 | absent | 91.1 | 0.25 | 0.63 | 20 |
| Comparative Example 28 | absent | 93.6 | 0.21 | 0.55 | 20 |
| Comparative Example 29 | absent | 93.3 | 0.23 | 0.58 | 21 |
| Comparative Example 30 | absent | 91.4 | 0.25 | 0.62 | 19 |
| Comparative Example 31 | absent | 93.9 | 0.22 | 0.56 | 22 |
| Comparative Example 32 | absent | 93.6 | 0.23 | 0.58 | 22 |
| Comparative Example 33 | absent | 91.8 | 0.25 | 0.63 | 20 |
| Comparative Example 34 | absent | 94.4 | 0.21 | 0.54 | 22 |
| Comparative Example 35 | absent | 93.6 | 0.23 | 0.59 | 23 |
| Comparative Example 36 | absent | 92.2 | 0.26 | 0.65 | 22 |
| Comparative Example 37 | present | 94.5 | 0.22 | 0.54 | 22 |
| Comparative Example 38 | present | 94.2 | 0.24 | 0.58 | 21 |
| Comparative Example 39 | present | 93 | 0.25 | 0.63 | 20 |
| Comparative Example 40 | present | 94.8 | 0.22 | 0.55 | 22 |
| Comparative Example 41 | present | 94.5 | 0.24 | 0.58 | 20 |
| Comparative Example 42 | present | 93.3 | 0.26 | 0.64 | 20 |
| Comparative Example 43 | present | 95.3 | 0.22 | 0.55 | 22 |
| Comparative Example 44 | present | 94.6 | 0.24 | 0.58 | 21 |
| Comparative Example 45 | present | 93.4 | 0.26 | 0.64 | 21 |
| Comparative Example 46 | present | 95.2 | 0.22 | 0.55 | 21 |

TABLE 6-continued

| Sample | Presence/absence of interference fringes by power spectrum | Electrophotographic characteristics charging voltage = −800 V: Retention rate after 1 second $Vk_1$ % | Sensitivity $E_{1/2}$ μJ/cm$^2$ | Sensitivity $E_{100}$ μJ/cm$^2$ | Residual potential VR5.0 V |
|---|---|---|---|---|---|
| Comparative Example 47 | present | 94.8 | 0.24 | 0.59 | 21 |
| Comparative Example 48 | present | 93.9 | 0.26 | 0.64 | 20 |
| Comparative Example 49 | present | 95.3 | 0.23 | 0.58 | 23 |
| Comparative Example 50 | present | 95.1 | 0.24 | 0.59 | 22 |
| Comparative Example 51 | present | 94.2 | 0.27 | 0.65 | 21 |
| Comparative Example 52 | present | 95.4 | 0.23 | 0.57 | 22 |
| Comparative Example 53 | present | 95.0 | 0.24 | 0.60 | 22 |
| Comparative Example 54 | present | 93.7 | 0.27 | 0.65 | 20 |

TABLE 7

| Sample | Result of image evaluation on actual apparatus: Resolution: 1-dot reproducibility | Resolution: fine white line resolution | Interference fringes rank | SB irregularities density: unevenness rank | OPC leak trace: temp/hum 24° C./43% | OPC leak trace: temp/hum 35° C./85% | stripe-shaped unevenness: temp/hum 24° C./43% | stripe-shaped unevenness: temp/hum 35° C./85% |
|---|---|---|---|---|---|---|---|---|
| Example 1 | faint | broad | 1 | 0 | none | none | none | none |
| Example 2 | faint | broad | 0.5 | 0 | none | none | none | none |
| Example 3 | good | good | 0.5 | 0 | none | none | none | none |
| Example 4 | good | good | 0 | 0 | none | none | none | none |
| Example 5 | good | good | 0 | 0 | none | none | none | none |
| Example 6 | good | good | 0 | 0 | none | none | none | none |
| Example 7 | good | good | 0 | 0 | none | none | none | none |
| Example 8 | good | good | 0 | 0 | none | none | none | none |
| Example 9 | good | good | 0 | 0 | none | none | none | none |
| Example 10 | good | good | 0 | 0 | none | none | none | none |
| Example 11 | good | good | 0 | 0 | none | none | none | none |
| Example 12 | good | good | 0 | 0 | none | none | none | none |
| Example 13 | good | good | 0 | 0 | none | none | none | none |
| Example 14 | good | good | 0 | 0 | none | none | none | none |
| Example 15 | good | good | 0 | 0 | none | present | none | present |
| Example 16 | good | good | 0 | 0 | none | none | none | none |
| Example 17 | good | good | 0 | 0 | none | present | none | present |
| Example 18 | good | good | 0 | 0 | none | present | none | present |
| Example 19 | faint | broad | 1 | 0 | none | none | none | none |
| Example 20 | faint | broad | 1 | 0 | none | none | none | none |
| Example 21 | good | good | 0.5 | 0 | none | none | none | none |
| Example 22 | good | good | 0 | 0 | none | none | none | none |
| Example 23 | good | good | 0 | 0 | none | none | none | none |
| Example 24 | good | good | 0 | 0 | none | none | none | none |
| Example 25 | good | good | 0 | 0 | none | none | none | none |
| Example 26 | good | good | 0 | 0 | none | none | none | none |
| Example 27 | good | good | 0 | 0 | none | none | none | none |
| Example 28 | good | good | 0 | 0 | none | none | none | none |
| Example 29 | good | good | 0 | 0 | none | none | none | none |
| Example 30 | good | good | 0 | 0 | none | none | none | none |
| Example 31 | good | good | 0 | 0 | none | none | none | none |
| Example 32 | good | good | 0 | 0 | none | none | none | none |
| Example 33 | good | good | 0 | 0 | none | none | none | none |
| Example 34 | good | good | 0 | 0 | none | none | none | none |
| Example 35 | good | good | 0 | 0 | none | present | none | present |
| Example 36 | good | good | 0 | 0 | none | present | none | present |

TABLE 8

| | Result of image evaluation on actual apparatus | | | | | | | |
|---|---|---|---|---|---|---|---|---|
| | Resolution | | | SB irregularities density | OPC leak trace | | stripe-shaped unevenness | |
| Sample | 1-dot reproducibility | fine white line resolution | Interference fringes rank | unevenness rank | temp/hum 24° C./43% | temp/hum 35° C./85% | temp/hum 24° C./43% | temp/hum 35° C./85% |
| Example 37 | faint | broad | 1.5 | 0 | none | none | none | none |
| Example 38 | faint | broad | 1 | 0 | none | none | none | none |
| Example 39 | good | good | 1 | 0 | none | none | none | none |
| Example 40 | good | good | 0 | 0 | none | none | none | none |
| Example 41 | good | good | 0 | 0 | none | none | none | none |
| Example 42 | good | good | 0 | 0 | none | none | none | none |
| Example 43 | good | good | 0 | 0 | none | none | none | none |
| Example 44 | good | good | 0 | 0 | none | none | none | none |
| Example 45 | good | good | 0 | 0 | none | none | none | none |
| Example 46 | good | good | 0 | 0 | none | none | none | none |
| Example 47 | good | good | 0 | 0 | none | none | none | none |
| Example 48 | good | good | 0 | 0 | none | none | none | none |
| Example 49 | good | good | 0 | 0 | none | none | none | none |
| Example 50 | good | good | 0 | 0 | none | none | none | none |
| Example 51 | good | good | 0 | 0 | none | none | none | none |
| Example 52 | good | good | 0 | 0 | none | none | none | present |
| Example 53 | good | good | 0 | 0 | none | present | none | none |
| Example 54 | good | good | 0 | 0 | none | present | none | present |
| Comparative Example 1 | faint | broad | 0 | 0.5 | none | none | none | none |
| Comparative Example 2 | faint | broad | 0 | 0.5 | none | none | none | none |
| Comparative Example 3 | good | good | 0 | 0.5 | none | none | none | none |
| Comparative Example 4 | faint | broad | 0 | 1 | none | none | none | none |
| Comparative Example 5 | faint | broad | 0 | 1 | none | none | none | none |
| Comparative Example 6 | good | good | 0 | 1 | none | none | none | none |
| Comparative Example 7 | good | good | 0 | 1.5 | none | none | none | none |
| Comparative Example 8 | good | good | 0 | 2 | none | present | none | present |
| Comparative Example 9 | good | good | 0 | 1.5 | none | present | none | none |
| Comparative Example 10 | good | good | 0 | 2 | none | none | none | none |
| Comparative Example 11 | good | good | 0 | 1.5 | none | none | none | none |
| Comparative Example 12 | good | good | 0 | 1.5 | none | present | none | none |
| Comparative Example 13 | good | good | 0 | 1.5 | none | present | none | present |
| Comparative Example 14 | good | good | 0 | 2 | none | present | none | present |
| Comparative Example 15 | good | good | 0 | 1.5 | none | present | none | present |
| Comparative Example 16 | good | good | 0 | 3 | none | present | none | present |
| Comparative Example 17 | good | good | 0 | 2 | none | present | none | present |
| Comparative Example 18 | good | good | 0 | 1 | none | present | none | present |

TABLE 9

| | Result of image evaluation on actual apparatus | | | | | | | |
|---|---|---|---|---|---|---|---|---|
| | Resolution | | | SB irregularities density | OPC leak trace | | stripe-shaped unevenness | |
| Sample | 1-dot reproducibility | fine white line resolution | Interference fringes rank | unevenness rank | temp/hum 24° C./43% | temp/hum 35° C./85% | temp/hum 24° C./43% | temp/hum 35° C./85% |
| Comparative Example 19 | faint | broad | 1 | 0.5 | none | none | none | none |
| Comparative Example 20 | faint | broad | 0.5 | 0.5 | none | none | none | none |
| Comparative Example 21 | good | good | 0.5 | 0.5 | none | none | none | none |
| Comparative Example 22 | faint | broad | 0 | 0.5 | none | none | none | none |
| Comparative Example 23 | faint | broad | 0 | 1 | none | none | none | none |
| Comparative Example 24 | good | good | 0 | 0.5 | none | none | none | none |
| Comparative Example 25 | good | good | 0 | 1 | none | none | none | none |
| Comparative Example 26 | good | good | 0 | 1 | none | none | none | none |
| Comparative Example 27 | good | good | 0 | 0 | none | present | none | present |
| Comparative Example 28 | good | good | 0 | 1 | none | none | none | none |
| Comparative Example 29 | good | good | 0 | 0.5 | none | present | none | present |
| Comparative Example 30 | good | good | 0 | 0 | none | present | none | present |
| Comparative Example 31 | good | good | 0 | 0.5 | none | none | none | none |
| Comparative Example 32 | good | good | 0 | 0 | none | present | none | present |
| Comparative Example 33 | good | good | 0 | 0 | none | present | none | present |
| Comparative Example 34 | good | good | 0 | 0.5 | none | present | none | present |
| Comparative Example 35 | good | good | 0 | 0.5 | none | present | none | present |
| Comparative Example 36 | good | good | 0 | 0 | none | present | none | present |
| Comparative Example 37 | faint | broad | 3.5 | 0 | none | none | none | none |
| Comparative Example 38 | faint | broad | 3 | 0 | none | none | none | none |

TABLE 9-continued

| | Result of image evaluation on actual apparatus | | | | | | | |
|---|---|---|---|---|---|---|---|---|
| | Resolution | | | SB irregularities density | OPC leak trace | | stripe-shaped unevenness | |
| Sample | 1-dot reproducibility | fine white line resolution | Interference fringes rank | unevenness rank | temp/hum 24° C./43% | temp/hum 35° C./85% | temp/hum 24° C./43% | temp/hum 35° C./85% |
| Comparative Example 39 | good | good | 2.5 | 0 | none | none | none | none |
| Comparative Example 40 | good | good | 2.5 | 0 | none | none | none | none |
| Comparative Example 41 | good | good | 2.5 | 0 | none | none | none | none |
| Comparative Example 42 | good | good | 2 | 0 | none | none | none | none |
| Comparative Example 43 | good | good | 2 | 0 | none | none | none | none |
| Comparative Example 44 | good | good | 1.5 | 0 | none | none | none | none |
| Comparative Example 45 | good | good | 1.5 | 0 | none | none | none | none |
| Comparative Example 46 | good | good | 1.5 | 0 | none | none | none | none |
| Comparative Example 47 | good | good | 1.5 | 0 | none | none | none | none |
| Comparative Example 48 | good | good | 1.5 | 0 | none | none | none | none |
| Comparative Example 49 | good | good | 1.5 | 0 | none | none | none | none |
| Comparative Example 50 | good | good | 1 | 0 | none | none | none | none |
| Comparative Example 51 | good | good | 1 | 0 | none | none | none | none |
| Comparative Example 52 | good | good | 0.5 | 0.5 | none | none | none | none |
| Comparative Example 53 | good | good | 0.5 | 1 | none | none | none | none |
| Comparative Example 54 | good | good | 0.5 | 0.5 | none | none | none | none |

On all the photosensitive member samples of Examples 1-54 and Comparative Examples 1-54, a reflectance $I_{opc}$ was measured by the method described in Example 1, in a laser beam wavelength range of 750≦λ≦812 nm, and was subjected to a discrete Fourier transformation according to a following equation (1). Since the number N of data to be employed for the discrete Fourier transformation has to be an exponential of 2, namely $N=2^s$ (s=1, 2, . . . , u) because of an algorithm of such transformation, data of the reflectance $I_{opc}$ were sampled by the aforementioned reflectance measuring apparatus (FIG. 16) with a wavelength interval of 2 nm (=Δλ) within the aforementioned range of wavelength λ and the discrete Fourier transformation was conducted on data of N=32 ($N=2^5$). Among the data obtained, those starting from s=1 were used since data at a frequency of an order s=0 are meaningless. The aforementioned wavelength range for data sampling was determined because the exposing laser light source mounted in commercially available printers generally has a central wavelength of 780 nm and a half-peak width of ±30-50 nm.

A Fourier transformation result S(n/(N·Δλ)), obtained as a complex number, is converted by a following equation (2) into a real number through calculation of $|S(n/(N\cdot\Delta\lambda))|^2$, which is plotted in the ordinate as a function of a frequency component (n/(N·Δλ)) in the abscissa to obtain a power spectrum. On representative ones among the photosensitive members prepared in the foregoing Examples and Comparative Examples, spectra showing reflectance $I_{opc}$ measured at a wavelength interval of 2 nm in the aforementioned wavelength range are shown in FIGS. 2 to 8 (Δ, □, ◆◆ indicating each measured datum). Except for such representative examples, measured reflectance values, a power spectrum based on such measurement values and a peak value Sp for Examples and Comparative Examples are not shown in the Tables, but Tables 4, 5 and 6 indicate that the interference fringes are "present" for a peak value Sp equal to or higher than 10 and "absent" for a peak value Sp less than 10. The measured data of the reflectance $I_{opc}$ corresponding to FIGS. 2-8 were subjected to a Fourier transformation according to the equations (1) and (2) to determine power spectrums, which are shown in FIGS. 9-15 with a power spectrum value in the ordinate and a frequency component in the abscissa. Numbers of Examples and Comparative Examples corresponding to FIGS. 2-8 and FIGS. 9-15 are shown in the following. In the frequency component in the abscissa of FIGS. 9-15, a description such as 5.0E+07 Hz or 1.0E+08 Hz indicates $5.0\times10^7$ Hz or $1.0\times10^8$ Hz, and other descriptions are given in a similar manner. Also a term "FFT Power" in the ordinate of these charts indicates a power spectrum value.

Figure 2:
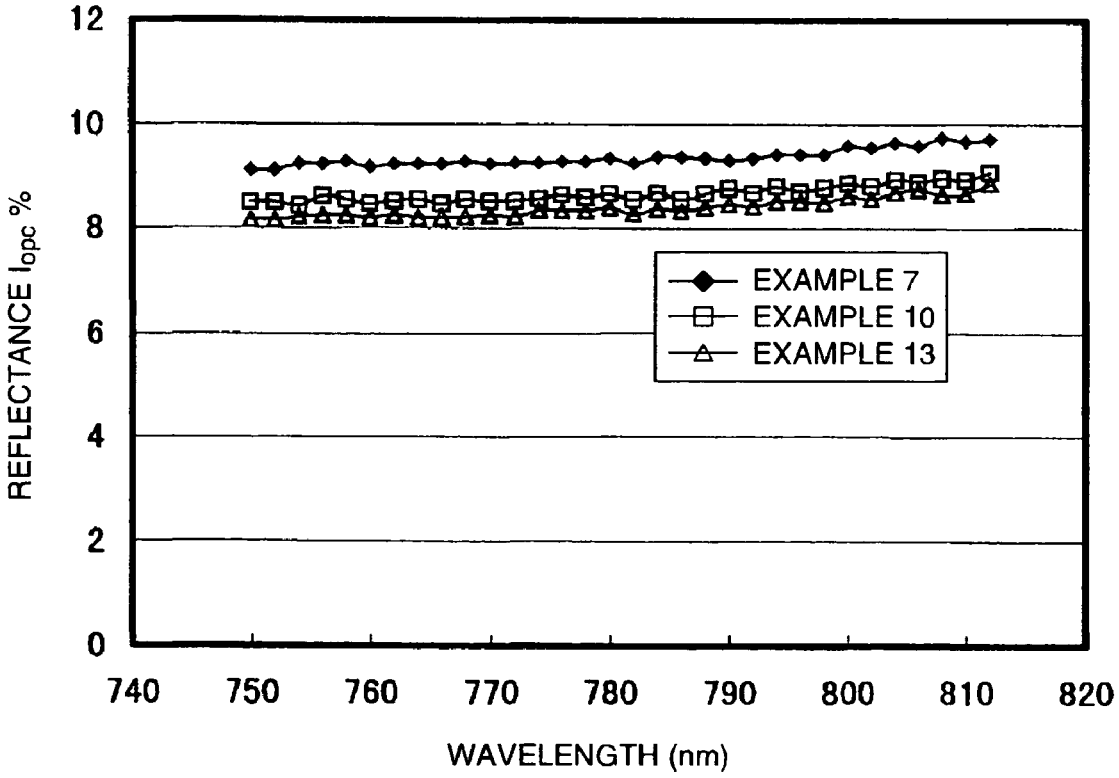
FIG. 2 is a reflectance spectrum of an electrophotographic photosensitive member without interference fringes.
Figure 8:
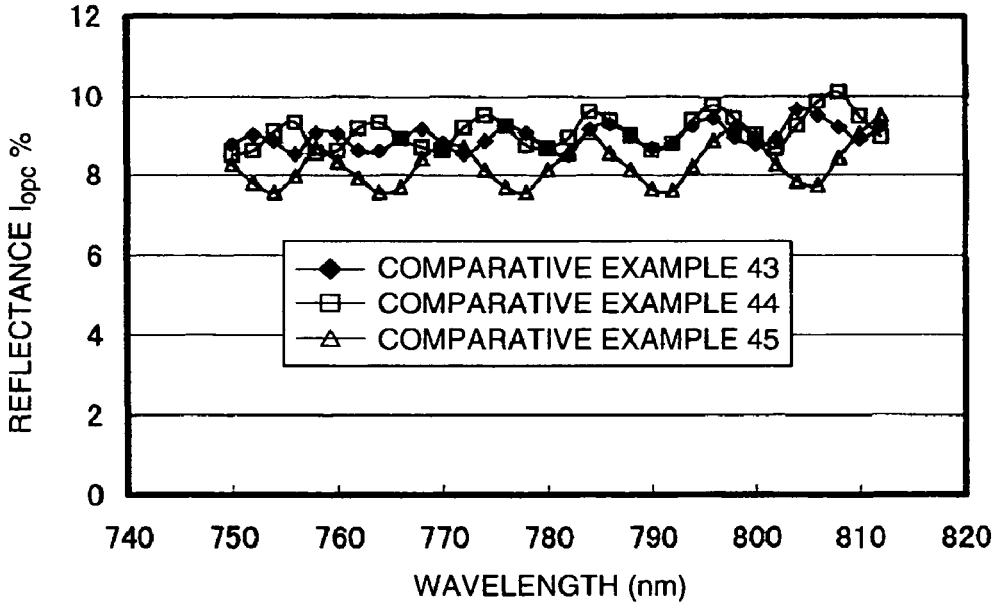
FIG. 8 is a reflectance spectrum of another electrophotographic photosensitive member showing interference fringes.
Figure 9:
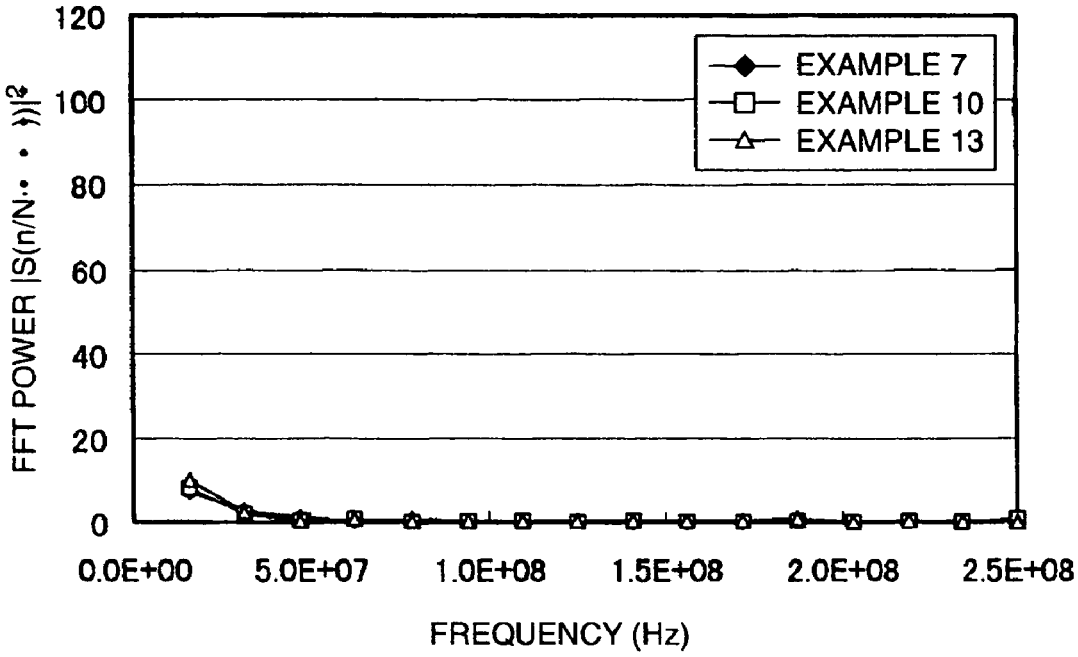
FIG. 9 is a power spectrum of an electrophotographic photosensitive member without interference fringes.
Figure 12:
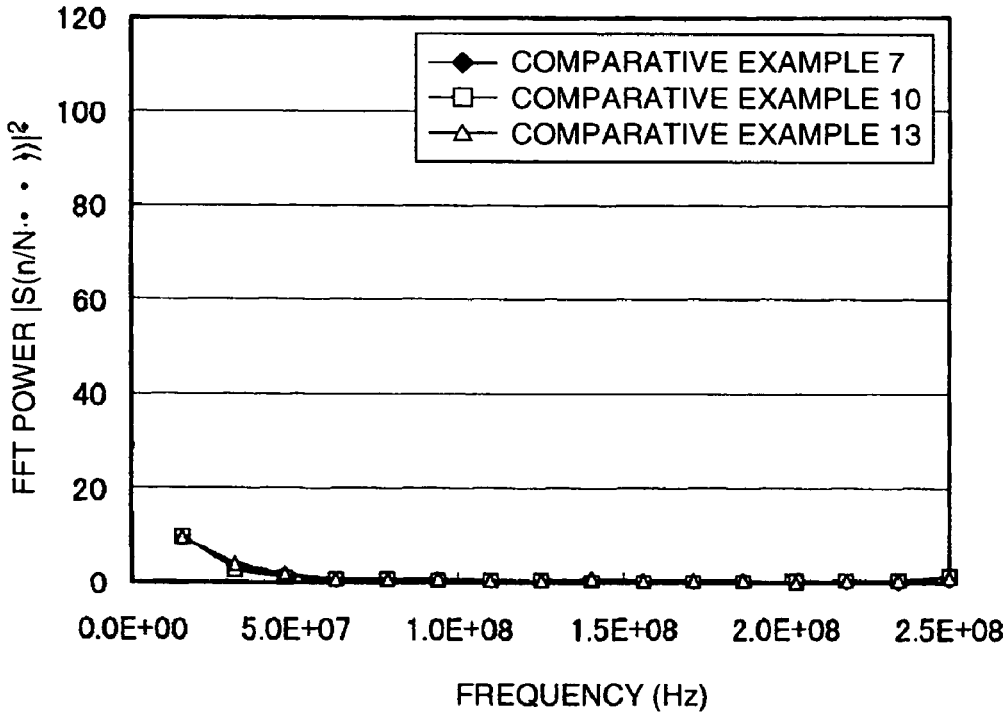
FIG. 12 is a power spectrum of another electrophotographic photosensitive member without interference fringes.
Figure 13:
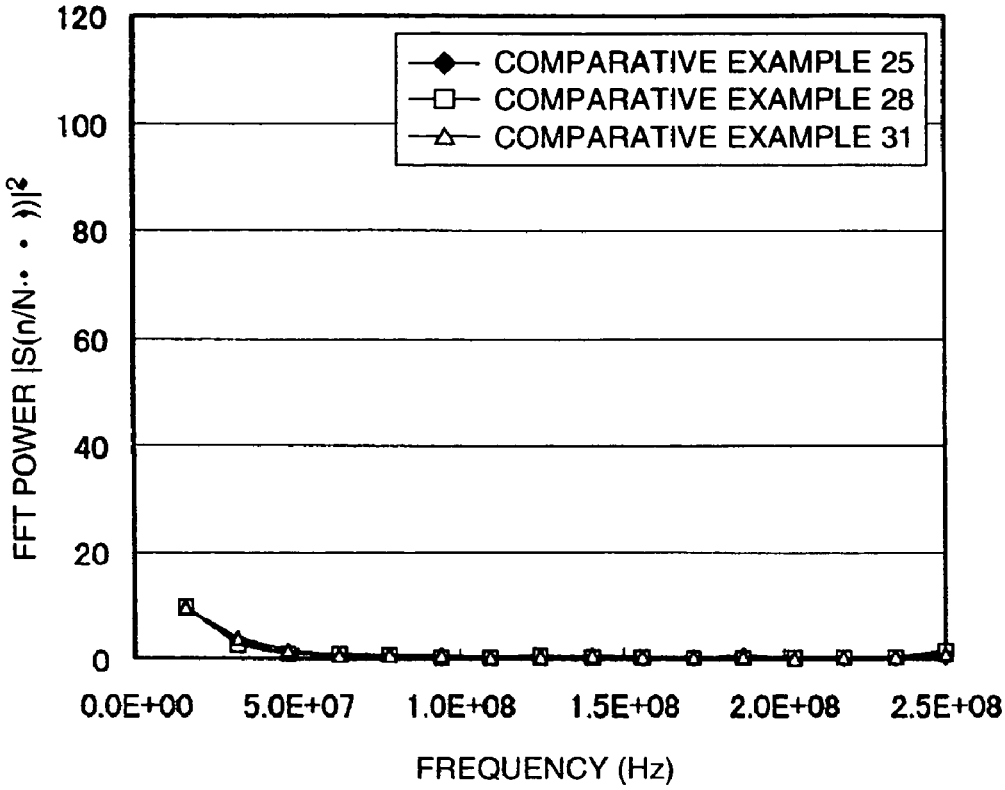
FIG. 13 is a power spectrum of another electrophotographic photosensitive member without interference fringes.

FIG. 2 shows reflectance spectra of the photosensitive members of Examples 7, 10 and 13, and FIG. 9 shows power spectra thereof. Similarly FIGS. 3 and 10 correspond to Examples 25, 28 and 31; FIGS. 4 and 11 to Examples 43, 46 and 49; FIGS. 5 and 12 to Comparative Examples 7, 10 and 13; FIGS. 6 and 13 to Comparative Examples 25, 28 and 31; and FIGS. 7 and 14 to Comparative Examples 43, 46 and 49. Of these Examples and Comparative Examples are extracted as representative examples, three each in each chart. Three examples in each group are different in the undercoat layer thickness varied as 2, 2.5 and 3 μm, and the examples in different groups are different in the surface roughness and the reflectance of the conductive substrate. Also, as representative examples of a photosensitive member showing relatively evident interference fringes, the reflectances and the power spectra of the photosensitive members of Comparative Examples 43, 44 and 45 are shown respectively in FIG. 8 and FIG. 15.

$$S\left(\frac{n}{N\cdot\Delta\lambda}\right)=\sum_{m=0}^{N-1} I_{OPC}(m\cdot\Delta\lambda)\exp\left(-i2\pi\cdot\frac{n}{N\cdot\Delta\lambda}\cdot m\cdot\Delta\lambda\right)=a+bi \tag{1}$$

wherein n and m represent integers, and N represents $N=2^s$ (s=1, 2, . . . , u); and $$\left|S\left(\frac{n}{N\cdot\Delta\lambda}\right)\right|^2=a^2+b^2 \tag{2}$$

For Examples 1-54 as shown in Tables 1, 2, 7 and 8, the 1-dot reproducibility and the fine white line resolution were satisfactory within a range of an undercoat layer thickness of 1.5-3.5 μm, but, at 4.0 μm, the 1-dot reproducibility test showed a faint dot edge, and the fine white line resolution test showed a broadened width because of a faint edge of a fine line. The interference fringes were not generated within a range of an undercoat layer thickness of 1.5-3.5 μm, but were slightly generated at 4.0 μm by a visual confirmation. The SB irregularity density unevenness was not generated in any of the undercoat layer thicknesses of 1.5-4.0 μm. The OPC (organic photosensitive layer) leak trace and the accompanying stripe-shaped unevenness were not generated, in an environmental condition of temperature/humidity=24° C./43%, in all undercoat layer thicknesses of 1.5-4.0 μm, but in an environmental condition of temperature/humidity=35° C./85%, the leak trace and the stripe-shaped unevenness were visually confirmed at a surface roughness Ra of 0.23 or 0.26 μm and an undercoat layer thickness of 1.5 μm.

Similarly, the leak trace and the stripe-shaped unevenness were visually confirmed at a surface roughness Ra of 0.35 μm and an undercoat layer thickness of 2.0 μm.

In Comparative Examples 1-18, as shown in Tables 2 and 8, the 1-dot reproducibility and the fine white line resolution were satisfactory within a range of an undercoat layer thickness of 1.5-3.0 μm, but, at 3.5 μm or larger, the 1-dot reproducibility test showed a faint dot edge, and the fine white line resolution test showed a broadened width because of a faint edge of a fine line. It was confirmed visually that interference fringes were not generated any of the undercoat layer thicknesses of 1.5-4.0 μm. The SB irregularity density unevenness was generated in all the undercoat layer thicknesses of 1.5-4.0 μm. The OPC (organic photosensitive layer) leak trace and the accompanying stripe-shaped unevenness were not generated, in an environmental condition of temperature/humidity=24° C./43%, in all the undercoat layer thickness of 1.5-4.0 μm, but in an environmental condition of temperature/humidity=35° C./85%, the leak trace and the stripe-shaped unevenness were confirmed to be generated not only at all the undercoat layer thickness of 1.5 and 2.0 μm but also even at the undercoat layer thickness of 3.0 μm.

In Comparative Examples 19-36, as shown in Tables 3 and 9, the 1-dot reproducibility and the fine white line resolution were satisfactory within a range of an undercoat layer thickness of 1.5-3.0 μm, but, at 3.5 μm or larger, the 1-dot reproducibility test showed a faint dot edge, and the fine white line resolution test showed a broadened width because of a faint edge of a fine line. It was confirmed visually that the interference fringes were not generated within the undercoat layer thickness of 1.5-3.5 μm but were slightly generated at the undercoat layer thickness of 4.0 μm. The SB irregularity density unevenness was alleviated in comparison with Comparative Examples 1-18, but was still generated, in all the undercoat layer thicknesses of 1.5-4.0 μm. The OPC (organic photosensitive layer) leak trace and the accompanying stripe-shaped unevenness were not generated, in an environmental condition of temperature/humidity=24° C./43%, in all the undercoat layer thickness of 1.5-4.0 μm, but in an environmental condition of temperature/humidity=35° C./85%, the leak trace and the stripe-shaped unevenness were confirmed to be generated not only at all the undercoat layer thickness of 1.5 and 2.0 μm but also even at the undercoat layer thickness of 3.0 μm.

In Comparative Examples 37-54, as shown in Tables 3 and 9, the 1-dot reproducibility and the fine white line resolution were satisfactory within a range of an undercoat layer thickness of 1.5-3.5 μm, but, at 4.0 μm, the 1-dot reproducibility test showed a faint dot edge, and the fine white line resolution test showed a broadened width because of a faint edge of a fine line. It was confirmed visually that the interference fringes were generated all the undercoat layer thicknesses of 1.5-4.0 μm. The SB irregularity density unevenness was not generated at the undercoat layer thicknesses of 2.0-4.0 μm, thus being better than in Comparative Examples 1-18 and 19-36, but was slightly confirmed at 1.5 μm. The OPC (organic photosensitive layer) leak trace and the accompanying stripe-shaped unevenness were confirmed not to be generated, in both environmental conditions of temperature/humidity=24° C./43% and 35° C./85%, in all the undercoat layer thicknesses of 1.5-4.0 μm.

As explained above, the evaluation results of the images on the actual apparatus are influenced not only by the average surface roughness Ra but also the film thicknesses of the undercoat layer and the charge transport layer.

Figure 3:
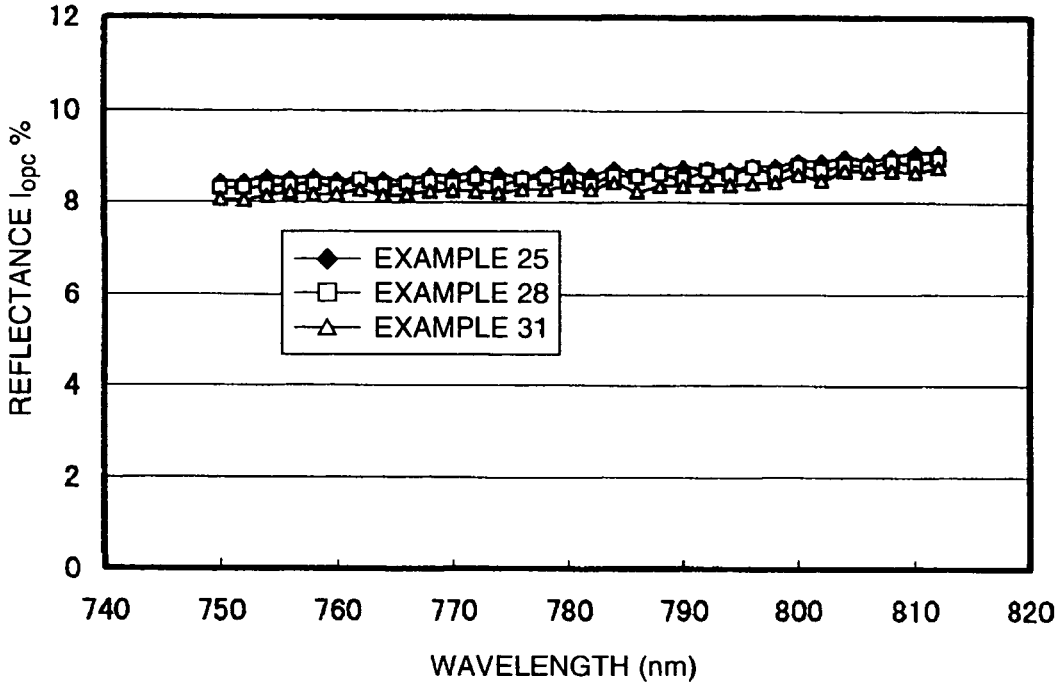
FIG. 3 is a reflectance spectrum of another electrophotographic photosensitive member without interference fringes.
Figure 4:
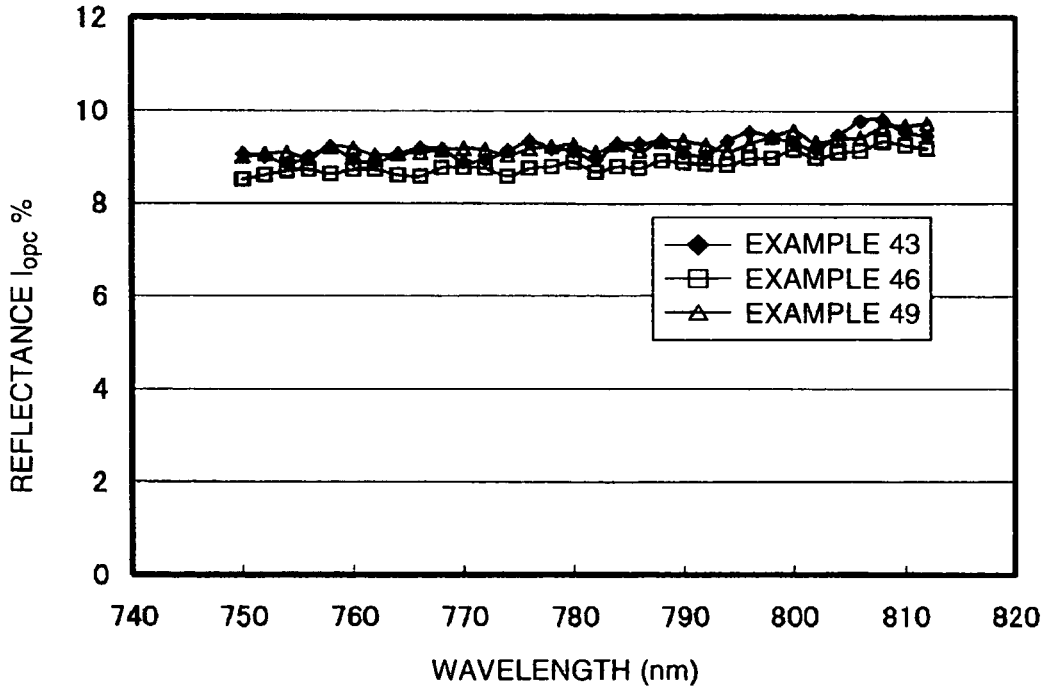
FIG. 4 is a reflectance spectrum of another electrophotographic photosensitive member without interference fringes.
Figure 5:
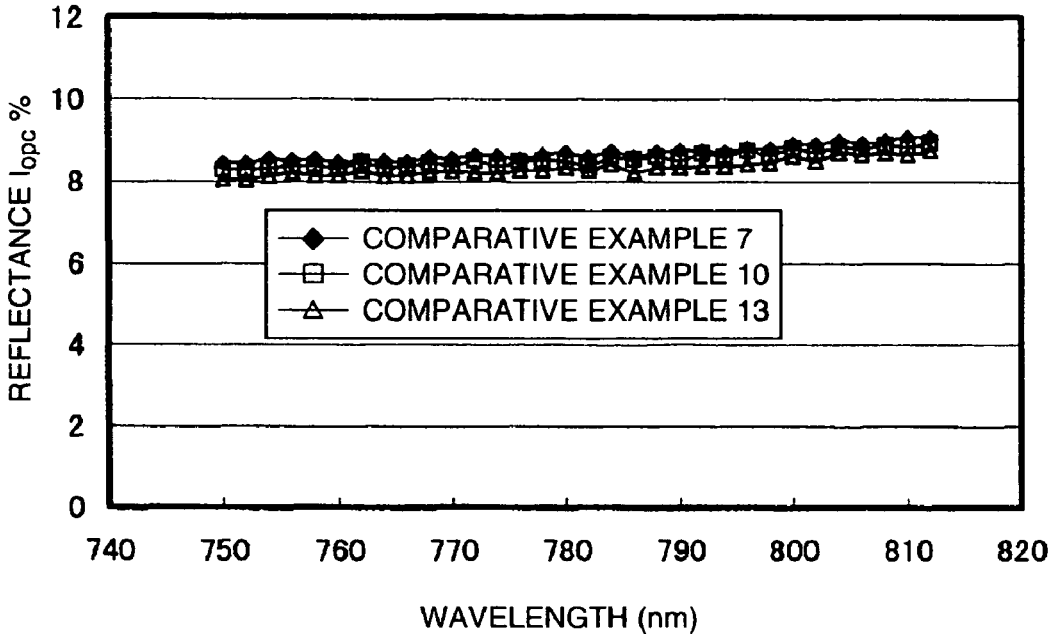
FIG. 5 is a reflectance spectrum of another electrophotographic photosensitive member without interference fringes.
Figure 6:
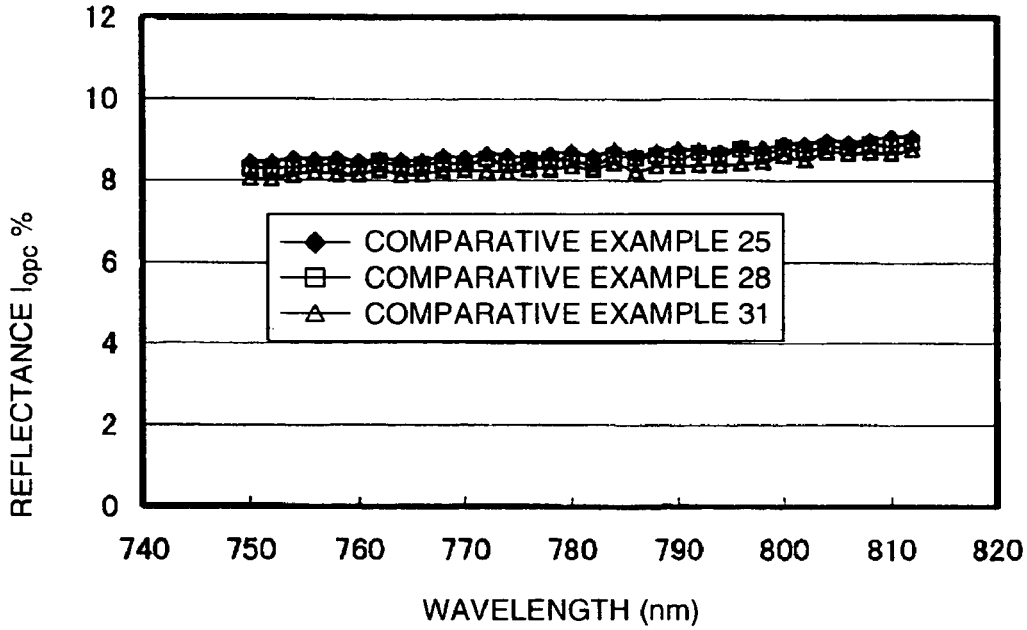
FIG. 6 is a reflectance spectrum of another electrophotographic photosensitive member without interference fringes.
Figure 7:
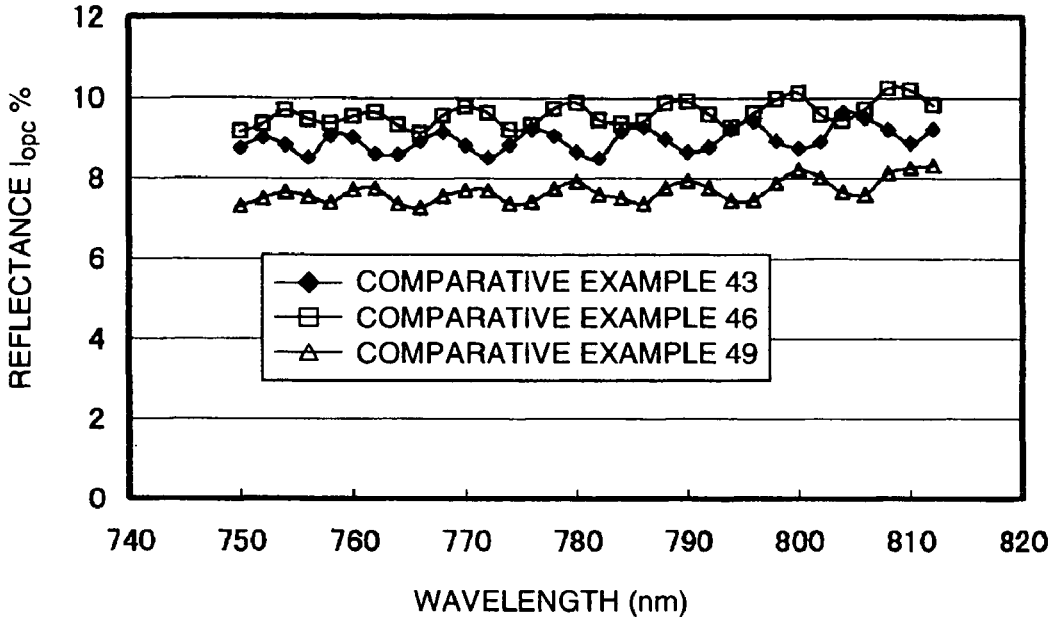
FIG. 7 is a reflectance spectrum of another electrophotographic photosensitive member showing interference fringes.

FIGS. 2-4 and 5-7 show spectra formed by plotting measured values of the reflectance $I_{opc}$ as a function of the wavelength λ of the incident light (wavelength interval Δλ=2 nm) for the organic photosensitive members of representative Examples and Comparative Examples. FIG. 2 show spectra of the reflectance $I_{opc}$ of the photosensitive members of Examples 7, 10 and 13, which have, as shown in Table 1, a substrate reflectance $I_{sb}$ of 13.6%, undercoat layer thicknesses of 3.0, 2.5 and 2.0 μm respectively, and a charge transport layer thickness of 20 μm. FIGS. 3 and 4 show spectra of the photosensitive members respectively of Examples 25, 28, 31 and 43, 46, 49 in which the substrate reflectance $I_{sb}$ was changed from 13.6% in FIG. 2 to 14.5% and 15.0% respectively. In the reflectance spectra, a certain cycle and an amplitude appear gradually stronger in the order of FIGS. 2, 3 and 4, so that optical interference is suspected from these spectra, but the evaluation results on the actual apparatus in the corresponding examples shown in Tables 7 and 8 show interference fringes of rank 0, thus indicating that the interference fringes were not generated on the image. The aforementioned amplitude increase in the spectrum of the reflectance $I_{opc}$ is considered to result from an increase in an interference intensity between an increased reflected light resulting from a surface smoothing of the undercoat layer caused by an increase in the reflectance $I_{sb}$ of the sand blasted conductive substrate in the order of FIGS. 2, 3, and 4, and the incident light.

The spectra of the reflectance $I_{opc}$ in FIGS. 5 and 6 (corresponding to Comparative Examples 7, 10, 13 and Comparative Examples 25, 28, 31) have shapes similar to those in FIGS. 2 and 3, and the evaluation results on the actual apparatus indicated that interference fringes were not generated. On the other hand, in FIG. 7 (corresponding to Comparative Examples 43, 46, 49), the reflectance spectra showed a large cycle and a large amplitude. Also the evaluation results on the actual apparatus provided interference fringes of a rank 1.5 as shown in Table 9, thus indicating the interference fringes generated on the image.

FIG. 8 shows spectra of the reflectance $I_{opc}$ of the photosensitive members (Comparative Examples 43, 44 and 45) in which the substrate reflectance $I_{sb}$ was 17.0%, the undercoat layer thickness was fixed at 3.0 μm and the thickness of the charge transport layer was changed respectively to 20, 18 and 14 μm. In this case, the reflectance spectra showed a cycle and a large amplitude. Also the evaluation results on the actual apparatus shown in Table 9 provided interference fringes of a rank 1.5, thus indicating clear interference fringes on the image.

The evaluation results of the optical interference, considered from the spectra of the reflectance $I_{opc}$ shown in FIGS. 2-8 are considered to be correlated with the evaluation results of the interference fringes on the halftone image in the actual apparatus, as shown in Tables 7-9. More specifically, in case the spectrum of the reflectance $I_{opc}$ has a shape with a cycle and an amplitude of a certain level or larger, interference fringes are anticipated to be generated on the image obtained in the actual apparatus. However, though the spectra shown in FIG. 4 (Examples 43, 46 and 49) have a cycle and an amplitude of a certain magnitude, but the interference fringes are not generated on the image in the actual apparatus. Therefore, in order to correlate the formation of the interference fringes on the image and the spectrum of the reflectance $I_{opc}$, it was considered necessary to evaluate by a power spectrum value obtained by a discrete Fourier transformation, as a feature quantity of the spectrum of the reflectance $I_{opc}$.

Figure 10:
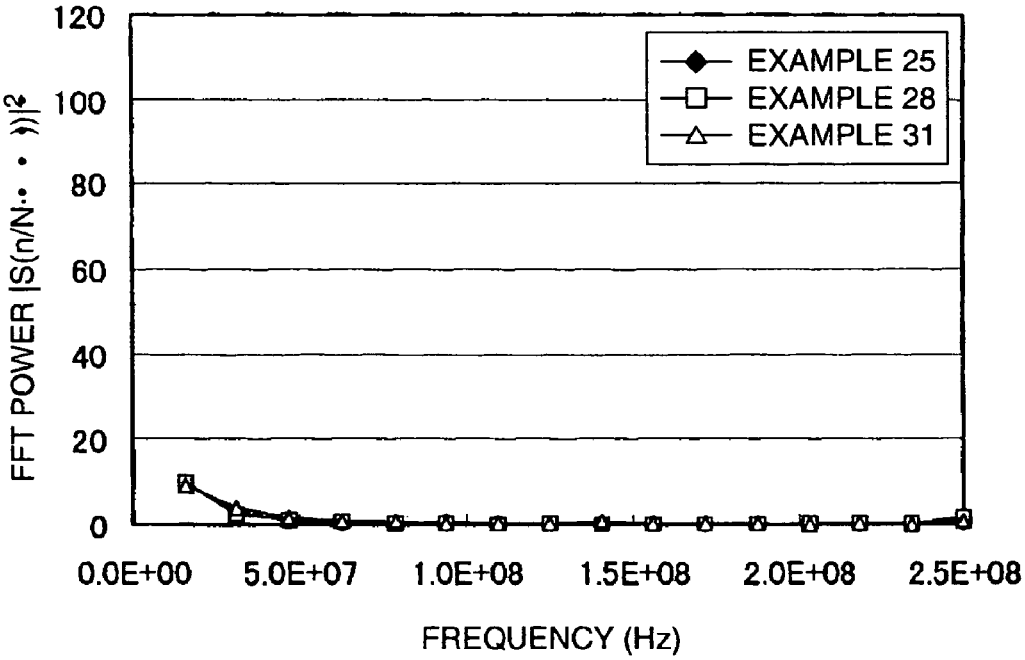
FIG. 10 is a power spectrum of another electrophotographic photosensitive member without interference fringes.
Figure 11:
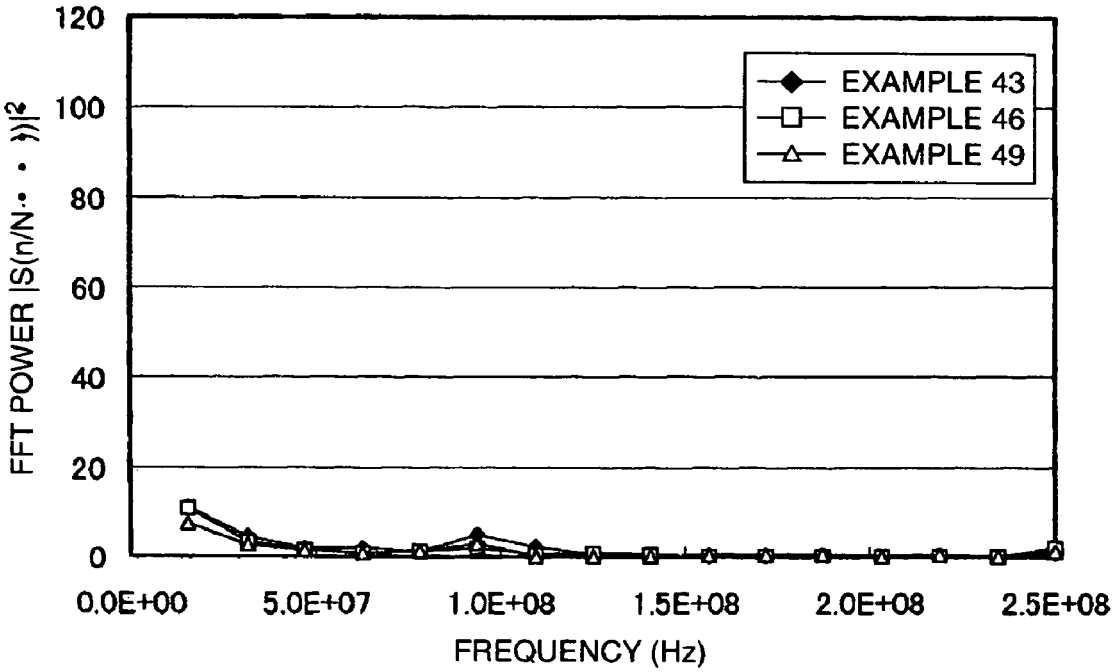
FIG. 11 is a power spectrum of another electrophotographic photosensitive member without interference fringes.
Figure 14:
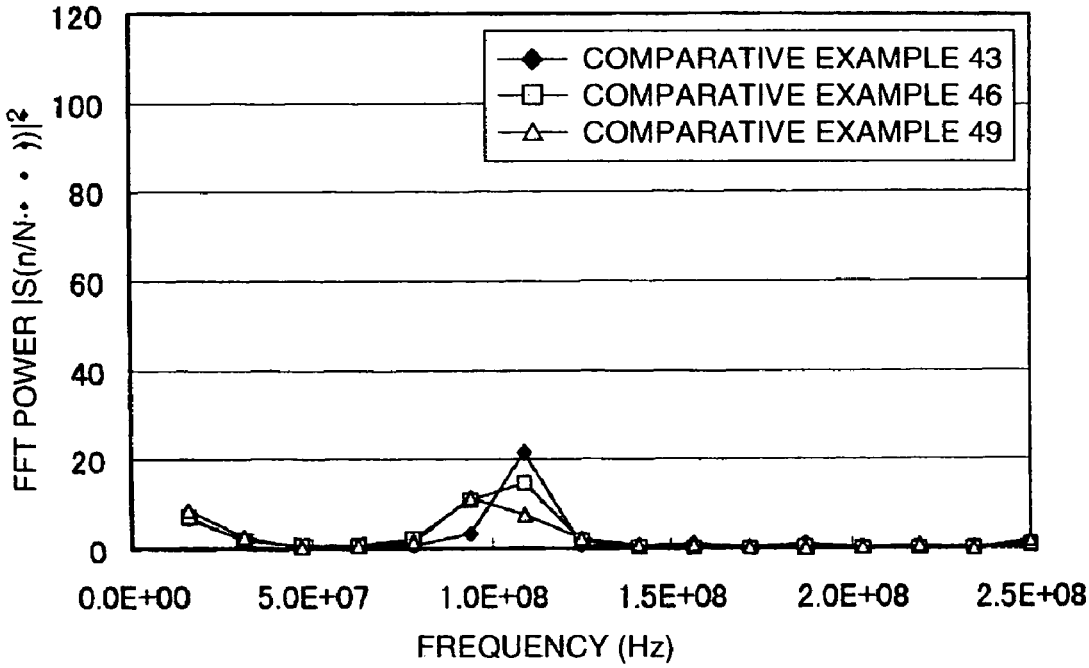
FIG. 14 is a power spectrum of an electrophotographic photosensitive member showing interference fringes.

FIGS. 9-11 (corresponding respectively to Examples 7, 10, 13; Examples 25, 28, 31; and Examples 43, 46, 49) and FIGS. 12-14 (corresponding respectively to Comparative Examples 7, 10, 13; Comparative Examples 25, 28, 31; and Comparative Examples 43, 46, 49) show representative examples of the power spectrum $|S(n/N\cdot\Delta\lambda)|^2$ obtained by the discrete Fourier transformation of the reflectance data of Examples and Comparative Examples, for which the aforementioned reflectance spectra were prepared. As in the foregoing reflectance spectra, these representative examples correspond to undercoat layer thicknesses of 3.0, 2.5 and 2.0 μm and a charge transport layer thickness of 20 μm. In the power spectra shown in FIGS. 9-11, FIGS. 9 and 10 not only do not have a peak value of 10 or higher in the evident maximum peak in the power spectrum but also lack any apparent peak, but FIG. 11 includes a peak of Sp=ca. 4.8 at $9.38\times10^7$ (Hz). However, the evaluation of the interference fringes on the image in Examples in FIG. 9-11 showed a rank 0, indicating the absence of interference fringes. Also in the power spectra shown in FIGS. 12-14, FIGS. 12 and 13 do not show, as in FIGS. 9 and 10, any peak that can be called an evident maximum peak, in the power spectrum, while FIG. 14 shows evident peaks of Sp=ca. 11.4, 14.6 and 21.5 in an increasing order, which are all equal to or larger than 10 in peak value and in which the maximum peak is as large as 21.5. Only the photosensitive members of Comparative Examples 43, 46, 49 corresponding to FIG. 14 actually generated interference fringes, thus showing a correlation with the generation of the interference fringes at a peak value of 10 or higher, whereby the presence/absence of interference fringe generation can be judged not by an image formation but by a reflectance measurement.

Figure 15:
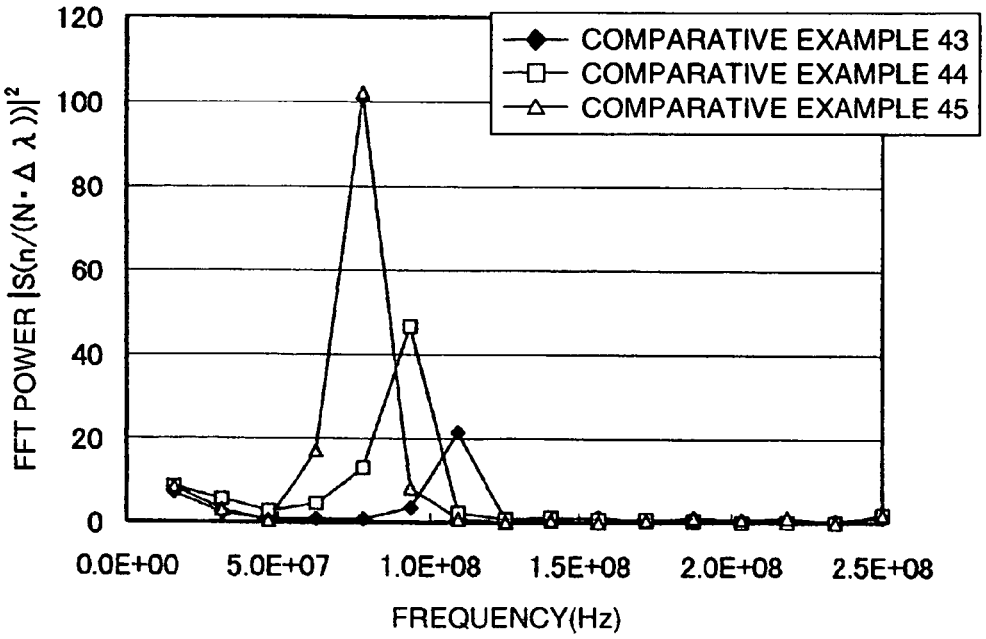
FIG. 15 is a power spectrum of another electrophotographic photosensitive member showing interference fringes.

FIG. 15 shows representative examples of the discrete Fourier transformed power spectrum $|S(n/N\cdot\Delta\lambda)|^2$ obtained from the measured data (FIG. 8) of the reflectance $I_{opc}$ of the photosensitive members having a substrate reflectance $I_{sb}$ of 17.0%, an undercoat layer thickness fixed at 3.0 μm, and charge transport layer thicknesses of 20, 18 and 14 μm. These samples of the photosensitive member were confirmed on the image to generate interference fringes. As all the peak values Sp in FIG. 15 are 20 or higher, the generation of the interference fringes can be judged even without an image observation, by preparing a power spectrum as shown in FIG. 15.

Based on these results, a threshold value is considered to exist for judging whether interference fringes are generated or not, just in case an evident maximum peak is present in the power spectrum. From a visual comparison of the interference fringes generated on the images obtained in the actual apparatus, an Sp range in which the interference fringe generation is within a practically acceptable level was identified as $Sp\leqq10$.

FIG. 15 corresponds to the reflectance spectra in FIG. 8 and shows power spectra for an undercoat layer thickness of 3.0 μm and charge transport layer thicknesses of 20, 18 and 14 μm. FIG. 15 shows that the power spectrum increases with a decrease in the thickness of the charge transport layer. As a function of the thickness of the charge transport layer, the interference fringes show a change in rank of about 0.5, indicating that the thickness of the charge transport layer affects the level of generation of the interference fringes and the shape of the power spectrum (Table 9).

On the other hand, as indicated by the evaluation results of the ranks of the interference fringes for Comparative Examples 37-54 in Table 9, the thickness of the undercoat layer within a range of 1.5-4.0 μm causes a variation of the interference fringes over 3 ranks, indicating that the interference fringes are affected more by the thickness of the undercoat layer than by the thickness of the charge transport layer. This is presumably ascribable to the fact that the charge transport layer influences the interference fringes in the actual apparatus not by its film thickness but by a deviation in the thickness of the charge transport layer in the axial and circumferential directions of the cylindrical conductive substrate. For example, the interference fringes are generated at least for a film thickness deviation of about 0.5 μm and a surface roughness Ra of the cylindrical conductive substrate of about 0.13 μm, while the charge transport layers in Examples 1-54 and Comparative Examples 1-54 have film thickness deviations of 0.7-2 μm (an average deviation of 1.5 μm in the axial direction and an average thickness deviation of 1.4 μm in the circumferential direction).

Based on these facts, it can be identified that, even for a charge transport layer with a large thickness deviation (about 2 μm), interference fringes can be suppressed by maintaining the surface of the conductive substrate at an average surface roughness Ra at $Ra\geqq0.23$ μm and a maximum surface roughness $R_{max}$ at $R_{max}\geqq2.4$ μm, and a thickness d of the undercoat layer at $1.5\ \mu m\leqq d\leqq3.5\ \mu m$.

However, even within the aforementioned ranges of the surface roughness, image quality may be affected by the resolution, the SB irregularity density unevenness, and the stripe-shaped unevenness on the halftone image resulting from the OPC (organic photosensitive layer) leak trace, as indicated in the foregoing evaluation results on the actual apparatus (Comparative Examples 1-36).

In contrast to the thick undercoat layer of thickness 1.5 μm or larger employed in the Examples and Comparative Examples, containing a resinous binder and a conductive metal oxide, a thick undercoat layer (1.5 μm or larger) not containing the metal oxide but constituted solely of a resinous binder caused detrimental effects on the electrophotographic characteristics and the image quality, although it could suppress the interference fringes. More specifically, a decrease in the sensitivity and an increase in the residual potential were observed in the electrophotographic characteristics, and these were reflected in the image quality by a decrease in a solid black density and a deterioration in the 1-dot reproducibility. The deterioration in the electrophotographic characteristics is presumably ascribable to the fact that, in a thick undercoat layer not containing the conductive metal oxide, the electrons generated by exposure do not flow into the substrate but cause a charge accumulation in the charge generation layer and at the interface of the charge generation layer and the undercoat layer, thereby inducing a decrease in the sensitivity and an increase in the residual potential. Based on this fact, the thick undercoat layer requires not only the resinous binder but also the conductive metal oxide in such resinous binder, for avoiding charge accumulation.

Based on the foregoing, in order not only to suppress the interference fringes but also to obtain satisfactory electrophotographic characteristics and to avoid detrimental effects on the image quality, it is preferable to have a surface roughness and a reflectance for the conductive substrate within ranges of $0.23\ \mu m\leqq Ra\leqq0.35\ \mu m$ and $2.4\ \mu m\leqq R_{max}\leqq2.7\ \mu m$, and a reflectance of the roughened conductive substrate at an incident wavelength $\lambda$=780 nm within a range of $I_{sb} \leqq 15\%$ (Examples 1-54), and more preferably to have, in the undercoat layer formed by coating on the roughened conductive substrate, a film thickness d within a range of 2 μm≦d≦3.5 μm and a reflectance within a range of $I_{ucl}<17\%$ (Examples 4-15, 22-33 and 40-51).

What is claimed is:

1. An electrophotographic photosensitive member, that is mountable in an electrophotographic apparatus including a coherent exposure light source, comprising:

a conductive substrate having a roughened surface which is roughened by a sand blasting process to provide a sand-blast-roughened surface;

a metal oxide-containing undercoat layer coated on the sand-blast-roughened surface and having a film thickness d within a range of 1.5 μm≦d≦3.5 μm; and an organic photosensitive layer coated on the metal oxide-containing undercoat layer;

wherein the electrophotographic photosensitive member satisfies a condition Sp≦10, and Sp is determined by (a) measuring a surface reflectance of coherent light from the electrophotographic photosensitive member at a plurality of predetermined wavelength intervals of width $\Delta\lambda$ within a wavelength range of 750 nm≦$\lambda$≦812 nm to obtain a measured surface reflectance;

(b) correcting the measured surface reflectance to obtain a corrected reflectance $I_{opc}$ of the electrophotographic photosensitive member, by taking a mirror-surface conductive substrate reflectance as a reference, and subjecting the corrected reflectance to a discrete Fourier transformation according to a following equation (1) and calculating, from a result of the equation (1), a power spectrum $|S(n/(N\cdot\Delta\lambda)|^2$ according to a following equation (2)

$$S\left(\frac{n}{N\cdot\Delta\lambda}\right)=\sum_{m=0}^{N-1} I_{OPC}(m\cdot\Delta\lambda)\exp\left(-i2\pi\cdot\frac{n}{N\cdot\Delta\lambda}\cdot m\cdot\Delta\lambda\right)=a+bi \quad (1)$$

wherein i represents $\sqrt{-1}$, n and m represent integers, and N represents $N=2^s$ (s=1, 2, . . . , u);

$$\left|S\left(\frac{n}{N\cdot\Delta\lambda}\right)\right|^2=a^2+b^2; \quad (2)$$

and (c) determining a peak value of the power spectrum $|S(n/(N\cdot\Delta\lambda))|^2$ within a frequency range of $0<n/(N\cdot\Delta\lambda(\mathrm{Hz})\leqq 2.5\times10^8$; and (d) setting the peak value of the power spectrum $|S(n/(N\cdot\Delta\lambda))|^2$ equal to Sp.

2. The electrophotographic photosensitive member according to claim 1, wherein the photosensitive layer comprises, laminated in succession from the conductive substrate, a charge generation layer including a charge generation material and a resinous binder, and a charge transport layer including a charge transport material and a resinous binder.

3. The electrophotographic photosensitive member according to claim 1, wherein the conductive substrate has an average surface roughness Ra within a range of 0.23 μm≦Ra≦0.35 μm, a maximum surface roughness $R_{max}$ within a range of 2.4 μm≦$R_{max}$≦2.7 μm, and a conductive-substrate reflectance $I_{sb}$ within a range of $0\leqq I_{sb}\leqq 15\%$, where a surface reflectance of a mirror-surface conductive substrate for a monochromatic light of wavelength $\lambda$=780 nm is taken as a reference reflectance for $I_{sb}$.

4. The electrophotographic photosensitive member according to claim 3, wherein the photosensitive layer comprises, laminated in succession from the conductive substrate, a charge generation layer including a charge generation material and a resinous binder, and a charge transport layer including a charge transport material and a resinous binder.

5. The electrophotographic photosensitive member according to claim 3, wherein $I_{sb}$ is determined according to a formula $$I_{sb}=\{(I_0-I_{dark})\div(I_{ref}-I_{dark})\}\times100(\%)$$

where $I_0$ is measured conductive-substrate reflectance, $I_{ref}$ is the reference reflectance, and $I_{dark}$ is a non-illuminated reflectance.

6. The electrophotographic photosensitive member according to claim 3, wherein the undercoat layer has a film thickness d within a range of 2 μm≦d≦3.5 μm and an undercoat-layer reflectance $I_{ucl}$ within a range of $0<I_{ucl}<17\%$, where a surface reflectance of a mirror-surface conductive substrate for a monochromatic light of a wavelength, $\lambda$=780 nm is taken as a reference reflectance.

7. The electrophotographic photosensitive member according to claim 6, wherein the photosensitive layer comprises, laminated in succession from the conductive substrate, a charge generation layer including a charge generation material and a resinous binder, and a charge transport layer including a charge transport material and a resinous binder.

8. The electrophotographic photosensitive member according to claim 6, wherein $I_{ucl}$ is determined according to a formula $$I_{ucl}=\{(I_0-I_{dark})\div(I_{ref}-I_{dark})\}\times100(\%),$$

where $I_0$ is a measured undercoat-layer reflectance, $I_{ref}$ is the reference reflectance, and $I_{dark}$ is a non-illuminated reflectance.

9. The electrophotographic photosensitive member according to claim 1, wherein the undercoat layer has a film thickness d within a range of 2 μm≦d≦3.5 μm and an undercoat-layer reflectance $I_{ucl}$ within a range of $0<I_{ucl}<17\%$, where a surface reflectance of a mirror-surface conductive substrate for a monochromatic light of a wavelength, $\lambda$=780 nm is taken as a reference reflectance.

* * * * *